US008835085B2

(12) United States Patent
Yu

(10) Patent No.: US 8,835,085 B2
(45) **Date of Patent: *Sep. 16, 2014**

(54) LOW STRAIN ANTI-CURL BACK COATING FOR FLEXIBLE IMAGING MEMBERS

(71) Applicant: Robert C. U. Yu, Webster, NY (US)

(72) Inventor: Robert C. U. Yu, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 163 days.

This patent is subject to a terminal disclaimer.

(21) Appl. No.: 13/627,570

(22) Filed: Sep. 26, 2012

(65) Prior Publication Data

US 2014/0087297 A1 Mar. 27, 2014

(51) Int. Cl.
*G03G 5/00* (2006.01)
*G03G 5/10* (2006.01)

(52) U.S. Cl.
USPC ..... 430/96; 430/56; 430/59.6; 430/69

(58) Field of Classification Search
CPC .. G03G 5/0564; G03G 5/50592; G03G 5/043
USPC ..... 430/56, 59.6, 69, 96
See application file for complete search history.

(56) References Cited

U.S. PATENT DOCUMENTS

| | | | |
|---|---|---|---|
| 3,121,006 | A | 2/1964 | Middleton |
| 4,286,033 | A | 8/1981 | Neyhart |
| 4,291,110 | A | 9/1981 | Lee |
| 4,338,387 | A | 7/1982 | Hewitt |
| 4,464,450 | A | 8/1984 | Teuscher |
| 4,587,189 | A | 5/1986 | Hor |
| 4,921,773 | A | 5/1990 | Melnyk |
| 5,069,993 | A | 12/1991 | Robinette |
| 5,153,094 | A | 10/1992 | Kazmaier |
| 5,166,156 | A | 11/1992 | Lavielle |
| 5,166,339 | A | 11/1992 | Duff |
| 5,189,155 | A | 2/1993 | Mayo |
| 5,189,156 | A | 2/1993 | Mayo |
| 5,382,486 | A | 1/1995 | Yu |
| 5,756,245 | A | 5/1998 | Esteghamatian |
| 7,166,399 | B2 | 1/2007 | Carmichael |
| 7,455,941 | B2 | 11/2008 | Evans |
| 7,462,434 | B2 | 12/2008 | Yu |
| 8,603,710 | B2 * | 12/2013 | Yu ..... 430/69 |

OTHER PUBLICATIONS

U.S. Appl. No. 12/782,671, filed May 18, 2010, Robert C.U. Yu.
U.S. Appl. No. 12/762,257, Apr. 16, 2010, Robert C.U. Yu.
U.S. Appl. No. 12/216,151, Jun. 30, 2008, Hye-Yeon Cha.

* cited by examiner

*Primary Examiner* — Thorl Chea
(74) *Attorney, Agent, or Firm* — Pillsbury Winthrop Shaw Pittman LLP

(57) ABSTRACT

Present embodiments relate generally to the flexible electrostatographic imaging members prepared to comprise a plasticized charge transport layer, plasticized ground strip layer, and a novel plasticized anti-curl back coating layer prepared to have internal stress/strain reduction, superb wear resistance property, and render the resulting flexible imaging members with absolute flatness to meet the functional requirement of electrostatographic imaging apparatuses. More particularly, the embodiments pertain to the reformulation of an anti-curl back coating layer comprising a novel high molecular weight film forming A-B diblock copolymer, a copolyester adhesion promoter, an organic or inorganic particles dispersion, and a plasticizer in the layer's material matrix.

31 Claims, 2 Drawing Sheets

LOW STRAIN ANTI-CURL BACK COATING FOR FLEXIBLE IMAGING MEMBERS

BACKGROUND

The presently disclosed embodiments relate generally to the flexible electrostatographic imaging members prepared to include the reformulation of a low stress/strain protective layer which provides not only superb wear/scratch resistance, but also renders the resulting flexible imaging members with flatness to meet the functional requirement of electrostatographic imaging apparatuses. More particularly, the embodiments pertain to the flexible multi-layered electrophotographic imaging member belts prepared to comprise plasticized imaging layer(s) and also include a low stress/strain anti-curl back coating formulated to provide a wear/scratch resistance film forming A-B diblock copolymer and a plasticizer to impart flexible imaging member curl control.

Flexible electrostatographic imaging members are well known in the art. Typical flexible electrostatographic imaging members include, for example: (i) electrophotographic imaging members (photoreceptors) commonly utilized in electrophotographic (xerographic) processing systems; (ii) electroreceptors such as ionographic imaging members for electrographic imaging systems; and (iii) intermediate toner image transfer members such as an intermediate toner image transferring member which is used to remove the toner images from a photoreceptor surface and then transfer the very images onto a receiving paper.

The electrostatographic imaging members are known to be in two configurations, for example, in flexible and in rigid configurations. The flexible electrostatographic imaging members may either be seamless or seamed belts. A flexible seamed imaging member belt is usually formed by cutting a rectangular imaging member sheet from a web stock, overlapping a pair of opposite ends, and welding the overlapped ends together to form a welded seam belt. Typical electrophotographic imaging member belts that include a charge transport layer and a charge generating layer on one side of a supporting substrate layer exhibit undesirable upward curling. Thus, an anti-curl back coating is usually coated onto the opposite side of the substrate layer to render imaging member belts flatness. A typical electrographic imaging member belt includes a dielectric imaging layer on one side of a supporting substrate. An anti-curl back coating is often needed on the opposite side of the substrate for curl control and render desired flatness. However, since the rigid electrostatographic imaging members utilize a rigid substrate support, no anti-curl back coating is needed for curl control.

In electrophotography, also known as xerography or electrophotographic imaging, the surface of an electrophotographic plate, drum, belt or the like containing a photoconductive insulating layer on a conductive layer is first uniformly electrostatically charged. The imaging member is then exposed to a pattern of activating electromagnetic radiation, such as light. Charge generated by the photoactive pigment moves under the force of the applied field. The movement of the charge through the photoreceptor selectively dissipates the charge on the illuminated areas of the photoconductive insulating layer while leaving behind an electrostatic latent image. This electrostatic latent image may then be developed to form a visible image by depositing oppositely charged particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

For a conventional negatively charged electrophotographic imaging member in flexible configuration, it is comprised of a single photoconductive/imaging layer (or compounded layers) that is (are) solution coated over the top of a thick flexible substrate support layer. In these flexible multiple-layered electrophotographic imaging member manufacturing processing, the charge transport layer (CTL) is coated over the charge generation layer (CGL) by applying a CTL coating solution directly over the CGL, then subsequently drying the wet applied CTL coating at elevated temperatures of about 120° C., and finally cooling down the coated imaging member to the ambient room temperature of about 25° C. Due to the thermal contraction mismatch between the CTL and the substrate support, the processed imaging member web (with finished CTL coating obtained through drying/cooling process) spontaneous curls upwardly into a roll. In these imaging member designs, the CTL has a typical coefficient of thermal contraction of from about 3 to about 4 times, or approximately 3.7 times, greater than that of the flexible substrate support. As a result, the CTL has a larger dimensional shrinkage than that of the flexible substrate support after through the process of application of wet CTL coating, drying it at elevated temperature, and the eventual imaging member web cools down to the ambient room temperature. The exhibition of imaging member web curling up after the completion of CTL coating and cooling down to room ambient is due to the consequence of larger CTL dimensional contraction than the substrate support as a result of the heating/cooling cycles of the manufacturing processing step To offset the curling, an anti-curl back coating (ACBC) is applied to the backside of the flexible substrate support, opposite to the side with a CTL, and render the imaging member web with desirable flatness.

But inclusion of an ACBC in the conventional negatively charged flexible imaging member incurs material cost, adds labor involvement, and also reduces imaging member product throughput, so activities devoted to ACBC elimination have been pursued. In the most recent negatively charged flexible electrophotographic imaging member improvement/development and break through, structurally simplified imaging member designs (with the elimination of an anti-curl back coating) have been successfully created and demonstrated through CTL plasticizing approach. Although the fabricated ACBC-free flexible imaging member on one hand is found to produce excellent photo-electrical functioning stability result as well as copy print out quality improvement advantages, it does, unfortunately, create an undesirable consequence because the surface of the bottom exposed substrate support layer (without the protection of an ACBC) is highly susceptible to the development of pre-mature onset of wear/scratch failure against the machine belt module support rollers and backer bars sliding mechanical friction action under a normal dynamic belt cycling machine operation condition. For belt use in the high volume elctrophotographic imaging machines and printers (utilizing large numbers of belt support module rollers and backer bars), substrate support exposure (without ACBC covering) in the ACBC-free imaging member belt has been found to cause early onset of substrate wear-off problem. Substrate support wear is very pronounced causing generation of large amount of debris and/or dust particles inside the machine cavity to adversely impede proper imaging member belt functional operation. Since the early development of substrate support layer wear-off to generate debris and/or dust particles inside the machine cavity, the debris/dust eventually deposits onto various machine subsystems and components which thereby interfere and adversely affect the electrophotographic imaging process and degrade the dynamic imaging member belt cyclic motion quality. As a result, frequent and costly premature imaging member belt replacement is required in the field.

Moreover, the ACBC-free imaging member prepared by relieving the CTL internal stress/strain through incorporation of plasticizer does not provide an entirely flat configuration which still does not meet the high volume machines imaging member belt flatness requirement.

The term "substantially flatness" or "nearly flat" refers in particular to an ACBC-free flexible negatively charge imaging member prepared to have the CTL incorporated with a plasticizer in its material matrix for effecting internal stress/strain reduction to give nearly flat configuration; that means the prepared imaging member exhibits an upward curling of at least equals to or greater than 14 inches in diameter of curvature.

Therefore, the known structurally simplified ACBC-free imaging member design exhibits deficiencies and shortfalls which are undesirable for use in advanced high volume automatic, cyclic electrophotographic imaging copiers, duplicators, and printers. To maintain the benefits offered by the imaging member containing a plasticized CTL and also resolve its associated issues, a novel ACBC design is now provided. More specifically, the present embodiments provide the imaging member with a re-designed ACBC reformulation having improvements of reduction in surface contact friction, less susceptibility to scratch/wear failure, and as well as rendering the prepared imaging member with absolute flatness. To achieve this purpose, flexible imaging members in various embodiments are prepared to contain a plasticized CTL and include an ACBC reformulation designed to comprise a high molecular weight film forming high molecular weight A-B diblock copolymer, adhesion promoter, liquid plasticizer, and organic or inorganic particles dispersion in the material matrix according to the descriptions of present disclosure.

SUMMARY

According to embodiments illustrated herein, there is provided a flexible imaging member comprising: a flexible substrate; a charge generation layer disposed on the substrate; at least one plasticized charge transport layer disposed on the charge generating layer; and a plasticized anti-curl back coating layer disposed on a side of the substrate opposite the charge generation layer and the plasticized charge transport layer, wherein the plasticized charge transport layer comprises a film forming polymer binder, a charge transport compound, and a plasticizer, and plasticized the anti-curl back coating layer comprises a liquid plasticizer and a high molecular weight film forming A-B diblock copolymer polycarbonate having a formula of:

Formula I $$R_1-(\text{[Block A]}_z-\text{[Block B]}_y)_n-OH$$

wherein Block A is a polycarbonate repeating unit, Block B is an organic acid containing repeating unit, z is from about 9 to about 45, y is from about 1 to about 6, n is between about 20 and about 80, and $R_1$ is H or $CH_3$, and the anti-curl back coating layer further comprises a liquid plasticizer.

In particular, the present embodiments provide a flexible imaging member comprising: a flexible substrate; a charge generation layer disposed on the substrate; at least one plasticized charge transport layer disposed on the charge generating layer; and a plasticized anti-curl back coating layer disposed on a side of the substrate opposite the charge generation layer and the plasticized charge transport layer, wherein the plasticized charge transport layer comprises a film forming polymer binder, a charge transport compound, and a plasticizer, and the plasticized anti-curl back coating layer comprises an adhesion promoter, a liquid plasticizer, an organic or inorganic particles dispersion in the anti-curl back coating layer and a high molecular weight film forming A-B diblock copolymer polycarbonate having a formula of:

Formula I $$R_1-(\text{[Block A]}_z\text{-[Block B]}_y)_n-OH$$

wherein Block A is a polycarbonate repeating unit, block B is an organic acid containing repeating unit, z is from about 9 to about 54, y is from about 1 to about 6, n is between about 20 and about 80, and $R_1$ is H or $CH_3$.

In further embodiments, there is provided a flexible imaging member comprising: a flexible substrate; a charge generation layer disposed on the substrate; at least one plasticized charge transport layer disposed on the charge generating layer; an overcoat layer disposed on the plasticized charge transport layer; a plasticized anti-curl back coating layer disposed on a side of the substrate opposite the charge generation layer and charge transport layer; and a plasticized ground strip layer disposed over one edge and adjacent to the plasticized charge transport layer of the flexible imaging member, wherein the plasticized charge transport layer, overcoat layer, plasticized anti-curl back coating layer and plasticized ground strip layer comprises a high molecular weight film forming A-B diblock copolymer polycarbonate having a formula of:

Formula I $$R_1-(\text{[Block A]}_z-\text{[Block B]}_y)_n-OH$$

wherein Block A is a polycarbonate repeating unit, Block B is an organic acid containing repeating unit, z is from about 9 to about 54, y is from about 1 to about 6, n is between about 20 and about 80, and $R_1$ is H or $CH_3$, and the plasticized anti-curl back coating layer further comprises an adhesion promoter and an organic or inorganic particle dispersion in the anti-curl back coating layer.

BRIEF DESCRIPTION OF THE DRAWINGS

To promote better understanding, reference may be made to the accompanying figures. The figures demonstrate cross-sectional views of a negatively charged multiple layered electrophotographic imaging member in a flexible belt configuration comprising a plasticized charge transport layer (CTL) and a plasticized anti-curl back coating layer (ACBC) prepared to have the material compositions formulated according to the description detailed in the present disclosure embodiments. The following is a brief description of the drawings, which are presented for the purposes of illustrating the exemplary embodiments disclosed herein and not for the purposes of limiting the same.

DETAILED DESCRIPTION OF THE DRAWINGS

Figure 1:
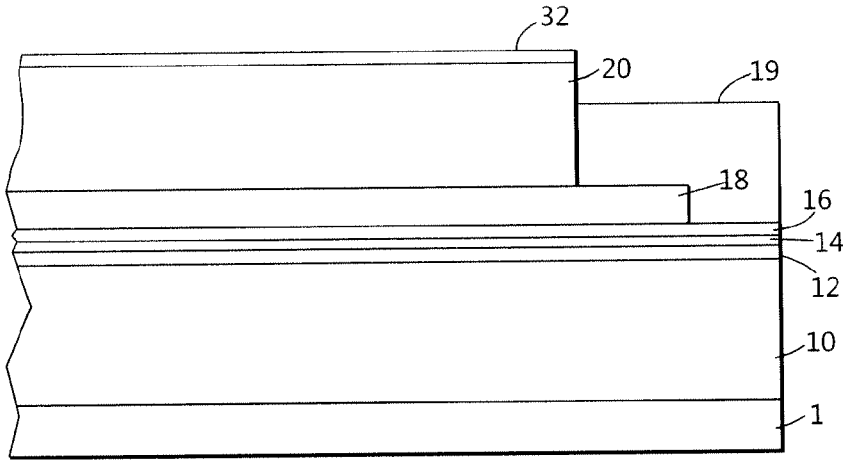
FIG. 1 is a schematic cross-sectional view of a first exemplary embodiment of a flexible imaging member having a plasticized CTL and a plasticized ACBC prepared according to the description of present disclosure.

In the following description, reference is made to the accompanying drawings, which form a part hereof and which illustrate the exemplary embodiments of the present disclosure herein and not for the purpose of limiting the same. It is also understood that other embodiments may be utilized and structural and operational changes may be made without departure from the scope of the present disclosure.

Conventional flexible negatively charged electrophotographic imaging member belts, comprising a single or composite photoconductive layers, such as for example, the GCL and CTL, through subsequent coating application of CGL over a flexible substrate support and CTL onto the CGL, exhibit undesirable upward imaging member curling. To offset and control the curl, an ACBC is required to be coated onto the back side (opposite to the photoconductive layer(s) side) of the substrate support to impart the imaging member with desirable flatness.

In the present effort, the disclosure is focused on improving this negatively charged flexible electrophotographic imaging member design to effect service life extension in the field. This is by means of providing methodology to render the resulting imaging member with photo-electrical stability enhancement as well as mechanically robust function to meet quality/cost reduction delivery objective. To achieve this very purpose, the flexible negatively charged multiple layered electrophotographic imaging member is to be prepared to contain a plasticized CTL over a CGL and a flexible supporting substrate plus the inclusion of a low stress/strain ACBC reformulation of present disclosure over the bottom surface of the substrate support to effect wear protection. The ACBC formulation of the present disclosure is a plasticized layer prepared to comprise of a novel high molecular weight film forming A-B diblock copolymer, a copolyester adhesion promoter, and a plasticizer in the layer's material matrix to provide (a) effective wear protect to the substrate support and (b) also internal stress/strain relief so that the resulting imaging member as obtained is curl-free and flat.

The disclosure may also alternatively provide this flexible negatively charged multiple layered electrophotographic imaging member (having a plasticized CTL over a CGL, a flexible supporting substrate, and plus a disclosed plasticized ACBC) with an optional top outermost protective overcoat layer over the CTL.

The exemplary embodiments of this disclosure are further described below with reference to the accompanying figures. The specific terms are used in the following description for clarity, selected for illustration in the drawings and not to define or limit the scope of the disclosure. The structures in the figures are not drawn according to their relative proportions and the drawings should not be interpreted as limiting the disclosure in size, relative size, or location. In addition, though the discussion will address negatively charged systems, the imaging members of the present disclosure may also included material compositions designed to be used in positively charged systems. Also the term "photoreceptor" or "photoconductor" or photosensitive member is generally used interchangeably with the terms "imaging member." The term "electrostatographic" includes "electrophotographic" and "xerographic." The terms "charge transport molecule" are generally used interchangeably with the terms "hole transport molecule."

Since the ACBC-free imaging member containing a plasticized CTL exhibits a less than entirely flat configuration which does not meet the high volume machines imaging member belt flatness requirement, the inclusion of a plasticized ACBC applied onto and cover the backside of the support substrate will eliminate the existing curling so as to render the imaging member curl-free and meet the strict flatness required. The preparation of the novel plasticized ACBC reformulation and its compositions will be described in detailed according to the following disclosures.

According to aspects illustrated herein, there is provided a flexible imaging member comprising a flexible substrate; a charge generating layer disposed on the substrate; a plasticized charge transport layer (CTL) disposed on the charge generating layer (CGL); and a plasticized anti-curl back coating (ACBC) of present disclosure disposed on the substrate on a side opposite to the CGL/CTL. The disclosed ACBC in one embodiment is prepared to comprise a film forming high molecular weight A-B diblock copolymer, a copolyester adhesion promoter, and a plasticizer.

FIG. 1 illustrates an exemplary embodiment of a negatively charged multi-layered flexible electrophotographic imaging member. Specifically, it shows the structure of a conventional flexible multiple layered electrophotographic imaging member comprising a substrate 10, an optional a conductive layer 12, an optional hole blocking layer 14 over the optional conductive layer 12, and an optional adhesive layer 16 over the blocking layer 14, a charge generating layer (CGL) 18, a charge transport layer (CTL) 20, an optional ground strip layer 19 operatively connects the CGL 18 and the CTL 20 to the optional conductive layer 12, an optional over coat layer 32, and an ACBC 1 to render appropriate imaging member flatness. A ground strip layer 19 may be included to effect electrical continuity. The optional overcoat layer 32 may be included to provide abrasion/wear protection for the CTL 20. Typically, the ACBC layer 1, being the outermost bottom layer, is to be applied onto the backside of substrate 10, opposite to the electrically active layers, for impacting imaging member curl control and provide substrate 10 protections against scratch/wear failure. An exemplary imaging member having a belt configuration is disclosed in U.S. Pat. No. 5,069,993, which is hereby incorporated by reference. U.S. Pat. Nos. 7,462,434; 7,455,941; 7,166,399; and 5,382,486 further disclose exemplary imaging members, which are hereby incorporated by reference.

Referring back to FIG. 1, embodiments of present disclosure are directed generally to an improved flexible imaging member, particularly for improving this very same flexible multiple layered electrophotographic imaging member, in which the CTL 20 is then included with a plasticizer to effect internal stress/strain reduction and the ACBC 1 is reformulated by the use of a high molecular weight film forming A-B diblock copolymer and likewise incorporated a plasticizer according to the description of this disclosure for effective curl control and improve mechanical function as well. The resulting imaging member thus obtained is curl-free and flat.

Although the formation and coating of the CGL 18 and the plasticized CTL 20 of the negatively charged imaging member described and shown in all the four the figures here has two separate layers, nonetheless it will also be appreciated that the functional components of these two layers may however be combined and formulated into a single plasticized layer to give a structurally simplified imaging member. Alternatively, the CGL 18 may also be disposed on top of the plasticized CTL 20, so the imaging member as prepared is therefore converted into a positively charge imaging member.

The Substrate

The imaging member support substrate 10 is a flexible layer and may be opaque but preferably to be substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed, such as for example, metal or metal alloy. Electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, niobium, stainless steel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and/or oxides.

The substrate 10 can also be formulated entirely of an electrically conductive material, or it can be an insulating material including inorganic or organic polymeric materials, such as MYLAR, a commercially available biaxially oriented polyethylene terephthalate (PET) from DuPont, or polyethylene naphthalate (PEN) available as KALEDEX 2000, with a ground plane layer 12 comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations.

The substrate 10 may have a number of different configurations, such as for example, a plate, a cylinder, a drum, a scroll, an endless flexible belt, and the like. In the case of the substrate being in the form of a belt, as shown in the figures, the belt can be seamed or seamless. In certain embodiments, the photoreceptor is rigid. In certain embodiments, the photoreceptor is in a drum configuration.

The thickness of the substrate 10 of a flexible belt depends on numerous factors, including flexibility, mechanical performance, and economic considerations. The thickness of the flexible support substrate 10 of the present embodiments may be from 1.0 to about 7.0 mils; or from about 2.0 to about 5.0 mils.

The substrate support 10 is not soluble in the solvents used in each of the coating layer solutions. The substrate support 10 is optically transparent or semi-transparent. The substrate support 10 remains physical/mechanical stable at temperature below about 170° C. Therefore, at or below 170° C. the substrate support 10, below which temperature, may have a thermal contraction coefficient ranging from about $1\times10^{-5}$/° C. to about $3\times10^{-5}$/° C. and a Young's Modulus of between about $5\times10^5$ psi ($3.5\times10^4$ Kg/cm$^2$) and about $7\times10^5$ psi ($4.9\times10^4$ Kg/cm$^2$).

The Ground Plane

The electrically conductive ground plane 12 may be an electrically conductive metal layer which may be formed, for example, on the substrate 10 by any suitable coating technique, such as a vacuum depositing technique. Metals include aluminum, zirconium, niobium, tantalum, vanadium, hafnium, titanium, nickel, stainless steel, chromium, tungsten, molybdenum, and other conductive substances, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer is from about 20 Angstroms to about 750 Angstroms, or from about 50 Angstroms to about 200 Angstroms, for an optimum combination of electrical conductivity, flexibility and light transmission.

Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as transparent layer for light having a wavelength between about 4000 Angstroms and about 9000 Angstroms or a conductive carbon black dispersed in a polymeric binder as an opaque conductive layer.

The Hole Blocking Layer

After deposition of the electrically conductive ground plane layer 12, the hole blocking layer 14 may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutryral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$, (gamma-aminopropyl) methyl diethoxysilane, as disclosed in U.S. Pat. Nos. 4,338,387, 4,286,033 and 4,291,110.

The hole blocking layer should be continuous and have a thickness of less than about 0.5 micrometer because greater thicknesses may lead to undesirably high residual voltage. A hole blocking layer of between about 0.005 micrometer and about 0.3 micrometer is used because charge neutralization after the exposure step is facilitated and optimum electrical performance is achieved. A thickness of between about 0.03 micrometer and about 0.06 micrometer is used for hole blocking layers for optimum electrical behavior. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is applied in the form of a dilute solution, with the solvent being removed after deposition of the coating by conventional techniques such as by vacuum, heating and the like. Generally, a weight ratio of hole blocking layer material and solvent of between about 0.05:100 to about 0.5:100 is satisfactory for spray coating.

The Adhesive Layer

An optional separate adhesive interface layer 16 may be provided in certain configurations, such as, for example, in flexible web configurations. In the embodiment illustrated in the figure, the interface layer 16 would be situated between the blocking layer 14 and the CGL 18. The interface layer may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-100, VITEL PE-200, VITEL PE-200D, and VITEL PE-222, all from Bostik Inc., 49,000 polyester from Rohm Hass, polyvinyl butyral, and the like. The adhesive interface layer may be applied directly to the hole blocking layer 14. Thus, the adhesive interface layer in embodiments is in direct contiguous contact with both the underlying hole blocking layer 14 and the overlying CGL 18 to enhance adhesion bonding to provide linkage. In yet other embodiments, the adhesive interface layer is entirely omitted.

Any suitable solvent or solvent mixtures may be employed to form a coating solution of the polyester for the adhesive interface layer. Solvents may include tetrahydrofuran, toluene, monochlorobenzene, methylene chloride, cyclohexanone, and the like, and mixtures thereof. Any other suitable and conventional technique may be used to mix and thereafter apply the adhesive layer coating mixture to the hole blocking layer. Application techniques may include spraying, dip coating, roll coating, wire wound rod coating, and the like. Drying of the deposited wet coating may be effected by any suitable conventional process, such as oven drying, infra red radiation drying, air drying, and the like.

The adhesive interface layer 16 may have a thickness of at least about 0.01 micrometer, and no more than about 900 micrometers after drying. In certain embodiments, the dried thickness is from about 0.03 micrometer to about 1.00 micrometer, or from about 0.05 micrometer to about 0.50 micrometer.

The Ground Strip Layer

The ground strip layer 19 may comprise a film-forming polymer binder and electrically conductive particles. Typical film forming binder may include, for example, A-B diblock copolymer, polycarbonate, polystyrene, polyacrylate, polyarylate, and the like. Any suitable electrically conductive particles may be used in the electrically conductive ground strip layer 19. The ground strip 19 may comprise materials which include those enumerated in U.S. Pat. No. 4,664,995. Electrically conductive particles include carbon black, graphite, copper, silver, gold, nickel, tantalum, chromium, zirconium, vanadium, niobium, indium tin oxide and the like. The electrically conductive particles may have any suitable shape. Shapes may include irregular, granular, spherical, elliptical, cubic, flake, filament, and the like. The electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The ground strip layer 19 may have a thickness of from about 7 micrometers to about 42 micrometers, from about 14 micrometers to about 27 micrometers, or from about 17 micrometers to about 22 micrometers.

The Charge Generation Layer

The CGL 18 may thereafter be applied to the undercoat layer 14. Any suitable charge generation binder including a charge generating/photoconductive material, which may be in the form of particles and dispersed in a film-forming binder, such as an inactive resin, may be utilized. Examples of charge generating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, enzimidazole perylene, and the like, and mixtures thereof, dispersed in a film-forming polymeric binder. Selenium, selenium alloy, benzimidazole perylene, and the like and mixtures thereof may be formed as a continuous, homogeneous charge generation layer. Benzimidazole perylene compositions are well known and described, for example, in U.S. Pat. No. 4,587,189, the entire disclosure thereof being incorporated herein by reference. Multi-charge generation layer compositions may be used where a photoconductive layer enhances or reduces the properties of the charge generation layer. Other suitable charge generating materials known in the art may also be utilized, if desired. The charge generating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

A number of titanyl phthalocyanines, or oxytitanium phthalocyanines for the photoconductors illustrated herein are photogenerating pigments known to absorb near infrared light around 800 nanometers, and may exhibit improved sensitivity compared to other pigments, such as, for example, hydroxygallium phthalocyanine. Generally, titanyl phthalocyanine is known to have five main crystal forms known as Types I, II, III, X, and IV. For example, U.S. Pat. Nos. 5,189,155 and 5,189,156, the disclosures of which are totally incorporated herein by reference, disclose a number of methods for obtaining various polymorphs of titanyl phthalocyanine. Additionally, U.S. Pat. Nos. 5,189,155 and 5,189,156 are directed to processes for obtaining Types I, X, and IV phthalocyanines. U.S. Pat. No. 5,153,094, the disclosure of which is totally incorporated herein by reference, relates to the preparation of titanyl phthalocyanine polymorphs including Types I, II, III, and IV polymorphs. U.S. Pat. No. 5,166,339, the disclosure of which is totally incorporated herein by reference, discloses processes for preparing Types I, IV, and X titanyl phthalocyanine polymorphs, as well as the preparation of two polymorphs designated as Type Z-1 and Type Z-2.

Any suitable inactive resin materials may be employed as a binder in the CGL 18, including those described, for example, in U.S. Pat. No. 3,121,006, the entire disclosure thereof being incorporated herein by reference. Organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like. Another film-forming polymer binder is PCZ-400 (poly(4,4'-dihydroxydiphenyl-1-1-cyclohexane) which has a viscosity-molecular weight of 40,000 and is available from Mitsubishi Gas Chemical Corporation (Tokyo, Japan).

The charge generating material can be present in the resinous binder composition in various amounts. Generally, the charge generating material is dispersed in an amount of from about 5 percent to about 95 percent by volume, from about 20 percent to about 80 percent by volume, or from about 40 percent to about 60 percent by volume of the resinous binder composition.

The CGL 18 containing the charge generating material and the resinous binder material generally ranges in thickness of from about 0.1 micrometer to about 5 micrometers, or from about 0.2 micrometer to about 3 micrometers. In certain embodiments, the charge generating materials in CGL 18 may include chlorogallium phthalocyanine, hydroxygallium phthalocyanines, or mixture thereof.

The CGL thickness is generally related to binder content. Higher binder content compositions generally employ thicker layers for charge generation layers.

The Conventional Charge Transport Layer

Although the CTL is discussed specifically in terms of a single layer 20, the details apply to embodiments having dual or multiple charge transport layers. The CTL 20 of conventional design is typically applied by solution coating over the CGL 18. In the coating process, the CTL along the adjacent ground strip layer is disposed on the CGL by co-coating application. The conventional CTL 20 may include a film forming transparent organic polymer or a non-polymeric material. Such transparent organic polymers and non-polymeric materials are capable of supporting the injection of photogenerated holes or electrons from the CGL 18 to allow the transport of these holes/electrons through the conventional CTL 20 to selectively discharge the surface charge on the imaging member surface. During the electrophotgraphic imaging process, the conventional CTL 20 supports holes transporting, and protects the CGL 18 from abrasion or chemical attack, thereby extends the service life of the imaging member. Interestingly, the conventional CTL 20 may be a substantially non-photoconductive material, yet it supports the injection of photogenerated holes from the CGL 18 below.

The conventional CTL 20 is normally transparent in a wavelength region in which the electrophotographic imaging member is to be used when exposure is affected there to ensure that most of the incident radiation is utilized by the underlying charge generation layer 18. The conventional CTL 20 should exhibit excellent optical transparency with negligible light absorption and no charge generation when exposed to a wavelength of light useful in xerography, e.g., 400 to 900 nanometers. In the case when the imaging member is prepared with the use of a transparent support substrate 10 and also a transparent conductive ground plane 12, image wise exposure or erase may alternatively (or optionally) be accomplished through the substrate 10 with all light passing through the back side of the support substrate 10. In this particular case, the materials of the conventional CTL 20 need not have to be able to transmit light in the wavelength region of use for electrophotographic imaging processes if the charge generating layer 18 is sandwiched between the support substrate 10 and the conventional CTL 20. In all events, the top conventional CTL 20 in conjunction with the charge generating layer 18 is an insulator to the extent that an electrostatic charge deposited/placed over the conventional CTL 20 is not conducted in the absence of radiant illumination. Importantly, the conventional CTL 20 should trap minimal or no charges as the charge pass through it during the image copying/printing process.

Typically, the conventional CTL 20 disclosed in all prior arts is a binary solid solution comprising a film forming polymer and charge transport compound or activating compound useful as an additive dissolved or molecularly dispersed in an electrically inactive polymeric material, such as a polycarbonate binder, to form a solid solution and thereby making this material electrically active. "Dissolved" refers, for example, to forming a solid solution in which the small molecule is dissolved in the polymer to form a homogeneous phase; and molecularly dispersed in all descriptions refers, for example, to charge transporting molecules dispersed in the polymer, the small molecules being dispersed in the polymer on a molecular scale.

The charge transport component may be added to a plasticized film-forming polymeric material which is otherwise incapable of supporting the injection of photogenerated holes from the charge generation material and incapable of allowing the transport of these holes through. This addition converts the electrically inactive polymeric material to a material capable of supporting the injection of photogenerated holes from the CGL 18 and capable of allowing the transport of these holes through the conventional CTL 20 in order to discharge the surface charge on the conventional CTL 20. The high mobility charge transport component may comprise small molecules of an organic compound which cooperate to transport charge between molecules and ultimately to the surface of the conventional CTL 20.

A number of charge transport compounds can be included in the conventional CTL 20. Examples of charge transport components are aryl amines of the following formulas:

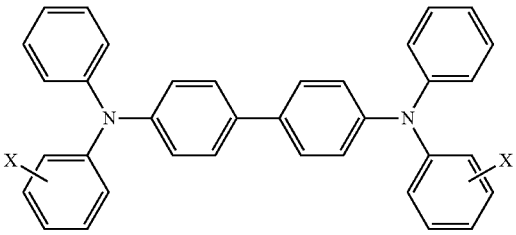

and

-continued

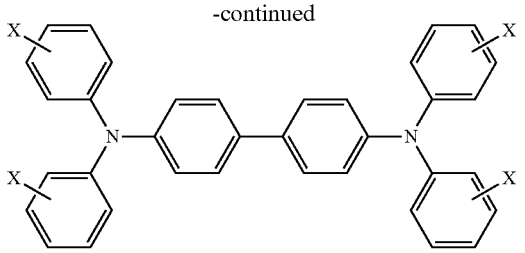

wherein each X is independently alkyl, alkoxy, aryl, and derivatives thereof, or a halogen, or mixtures thereof. In certain embodiments, each X is independently Cl or methyl. Additional examples of charge transport components are aryl amines of the following formulas:

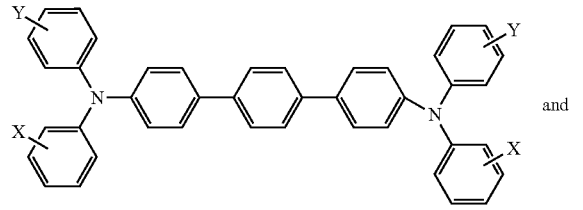

and

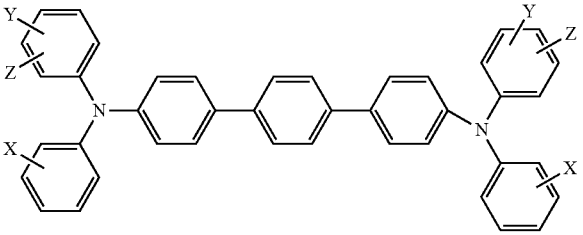

wherein X, Y and Z are independently alkyl, alkoxy, aryl, halogen, or mixtures thereof, and wherein at least one of Y and Z are present.

Alkyl and alkoxy may be substituted or unsubstituted, containing from 1 to about 25 carbon atoms, and more specifically, from 1 to about 12 carbon atoms, such as methyl, ethyl, propyl, butyl, pentyl, and the corresponding alkoxides. Aryl may be substituted or unsubstituted, containing from 6 to about 36 carbon atoms, such as phenyl, and the like. Halogen includes chloride, bromide, iodide, and fluoride.

Exemplary charge transport components include aryl amines such as N,N'-diphenyl-N,N'-bis(methyllphenyl)-1,1-biphenyl-4,4'-diamine, N,N,N',N'-tetra-p-tolyl-1,1'-biphenyl-4,4'-diamine, N,N'-diphenyl-N,N'-bis(chlorophenyl)-1,1'-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine, In one embodiment, the charge transport component is N,N'-diphenyl-N,N'-bis(3-methyl phenyl)-1,1'-biphenyl-4,4'-diamine (TPD) and N,N,N',N'-tetra-p-tolyl-1,1'-biphenyl-4,4'-diamine (TM-TPD), and the like. Other known charge transport layer components may be selected in embodiments, reference for example, U.S. Pat. Nos. 4,921,773 and 4,464,450, the disclosures of which are totally incorporated herein by reference.

In one embodiment, the charge transport component is N,N'-diphenyl-N,N-bis(3-methyl phenyl)-1,1'-biphenyl-4,4'-diamine (TPD). In another embodiment, the charge transport component is N,N,N',N'-tetra-p-tolyl-1,1'-biphenyl-4,4'-diamine (TM-TPD).

Examples of the binder materials selected for the CTL 20 include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof. In one embodiment, the charge transport layer includes polycarbonates.

Typically, the formulation of the conventional CTL 20 is a solid solution which includes a charge transport compound molecularly dispersed or dissolved in a film forming polycarbonate binder, such as poly(4,4'-isopropylidene diphenyl carbonate) (i.e., bisphenol A polycarbonate), or poly(4,4'-diphenyl-1,1'-cyclohexane carbonate) (i.e., bisphenol Z polycarbonate).

Bisphenol A polycarbonate used for the conventional CTL 20 formulation is available commercially: MAKROLON (from Farbensabricken Bayer A.G) or FPC 0170 (from Mitsubishi Chemicals). Bisphenol A polycarbonate, poly(4,4'-isopropylidene diphenyl carbonate), has a weight average molecular weight of from about 80,000 to about 250,000, and a molecular structure of Formula X below:

Formula X

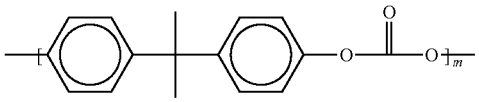

wherein m is the degree of polymerization, from about 310 to about 990. Bisphenol Z polycarbonate, poly(4,4'-diphenyl-1,1'-cyclohexane carbonate), has a weight average molecular weight of from about 80,000 to about 250,000, and a molecular structure of Formula Y below:

Formula Y

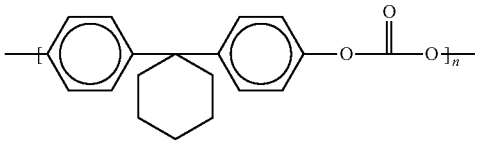

wherein n is the degree of polymerization, from about 270 to about 850.

The conventional CTL 20 is an insulator to the extent that the electrostatic charge placed on the conventional CTL 20 surface is not conducted in the absence of illumination at a rate sufficient to prevent formation and retention of an electrostatic latent image thereon. The conventional CTL 20 is substantially non-absorbing to visible light or radiation in the region of intended use. The conventional CTL 20 is yet electrically "active," as it allows the injection of photogenerated holes from the charge generation layer 18 to be transported through itself to selectively discharge a surface charge presence on the surface of the conventional CTL 20.

Any suitable and conventional technique may be utilized to form and thereafter apply the conventional CTL 20 coating solution to the supporting substrate layer. The conventional CTL 20 may be formed in a single coating step to give single conventional CTL 20 or in multiple coating steps to produce dual layered or multiple layered CTLs. Dip coating, ring coating, spray, gravure or any other coating methods may be used. For dual layered design, the CTL 20 includes a top CTL and a bottom CTL in contiguous contact with the CGL 18. The top CTL may contain less charge transport compound than the bottom CTL for impacting mechanically robust function. The top and bottom CTLs may have different thickness, or the same thickness. Drying of the applied wet coating layer(s) may be effected by any suitable conventional technique such as oven drying, infra red radiation drying, air drying and the like.

During the manufacturing process of a conventional negatively charged flexible imaging member, the conventional CTL 20 is coated over the CGL 18 by applying a CTL solution coating on top of the CGL 18, then subsequently drying the wet applied CTL coating at elevated temperatures of about 120° C., and finally cooling down the coated imaging member web to the ambient room temperature of about 25° C. Due to the thermal contraction mismatch between the conventional CTL 20 and the substrate support 10, the processed imaging member web (after finishing CTL drying/cooling process), if unrestrained, does exhibit spontaneous upward curling as a result of greater dimensional contraction of conventional CTL 20 than that of substrate support 10.

Without being bounded by theory, the development of this upward imaging member curling may be explained by the following mechanisms:

(1) while the imaging member web after application of wet CTL coating (typically comprising equal parts of a polycarbonate binder and a specific diamine charge transport compound dissolved in an organic solvent) over a 3½ mil polyethylene naphthalate substrate (or a polyethylene terephthalate) is dried at elevated temperature (120° C.), the solvent(s) of the CTL coating solution evaporates leaving a viscous free flowing CTL liquid where the CTL releases internal stress, and maintains its lateral dimension stability without causing the occurrence of dimensional contraction;

(2) during the cool down period, the temperature falls and reaches the glass transition temperature (Tg) of the CTL at 85° C., the CTL instantaneously solidifies and adheres to the underneath CGL as it transforms from being a viscous liquid into a solid layer; and (3) as the CTL temperature subsequently drops from its Tg of 85° C. down to the 25° C. room ambient, the solid CTL in the imaging member web laterally contracts more than the flexible substrate support due to significantly higher thermal coefficient of dimensional contraction than that of the substrate support. Such differential in dimensional contraction between these two layers results in internal tension strain built-up in the CTL and compression the substrate support layer, which therefore pulls the imaging member web upwardly to exhibit curling. That means the processed Imaging member web (with the finished CTL coating obtained through drying/cooling process) does spontaneously curl upwardly into a roll.

The internal tension pulling strain built-up in the dried CTL 20 (caused by differential dimensional contraction between CTL 20 and substrate 10 to result in spontaneous upward imaging member curling) can be calculated according to the expression of equation (1) below:

$$\epsilon = (\alpha_{CTL} - \alpha_{sub})(Tg_{CTL} - 25^\circ\ C.) \quad (1)$$

wherein $\epsilon$ is the internal strain build-in in the charge transport layer, $\alpha_{CTL}$ and $\alpha_{sub}$ are coefficient of thermal contraction of conventional CTL 20 and substrate 10 respectively, and $Tg_{CTL}$ is the glass transition temperature of the conventional CTL 20.

The thickness of the CTL (being a single, dual, or multiple layered CTLs) after drying is from about 10 micrometers to about 40 micrometers or from about 12 micrometers to about 36 micrometers for optimum photoelectrical and mechanical results. In another embodiment the thickness is from about 14 micrometers to about 36 micrometers. The conventional CTL 20 does typically have a Young's Modulus in the range of from about $2.5\times10^5$ psi ($1.7\times10^4$ Kg/cm$^2$) to about $4.5\times10^5$ psi ($3.2\times10^4$ Kg/cm$^2$) and a thermal contraction coefficient of between about $6\times10^{-5}$/° C. and about $8\times10^{-5}$/° C.

In essence, if the completed imaging member web has a 29-micrometer thickness of dried conventional CTL 20 (comprising equal parts of a polycarbonate binder and a specific diamine charge transport compound) over a 3½ mil polyethylene naphthalate (or a polyethylene terephthalate) substrate support 10, and being unrestrained, it does spontaneously curl-up into a 1½-inch roll. So to balance the curl and render desirable imaging member flatness, an ACBC having a conventional composition is generally included in prior imaging members.

The Conventional Anti-Curl Back Coating Layer

As the imaging member web exhibits spontaneous upward curling after the completion of the conventional CTL 20 coating/drying and cooling processes, a conventional ACBC 1 is applied to the back side of the substrate 10 to counteract the curl and render flatness. Typically, a conventional ACBC for effective curl control is formulated to comprised of a film forming polymer and a small amount of an adhesion promoter. Although the film forming polymer employed in the conventional ACBC 1 formulation may be different from the polymer binder used in the conventional CTL 20, but it is preferred to be the exact same one as that in the conventional CTL. It is also important to mention that that the polymer(s) used in the conventional ACBC formulation and that in the conventional CTL has about equivalent thermal contraction coefficient to effect best imaging member curl control outcome.

The applied conventional ACBC is, however, required to have suitable optically transmittance (e.g., transparency), so that the residual voltage remaining after completion of a photoelectrical imaging process on the imaging member surface can conveniently be erased by radiation illumination directed from the back side of the imaging member through the ACBC thickness of the imaging member during electrophotographic imaging processes. In addition, since the imaging member in flexible belt configuration is mounted over to encircle around a machine belt module and be supported by a number of belt module rollers and backer bars, so it is necessary that the ACBC (under a dynamic imaging member belt cyclic machine functioning condition in the field) should also have adequate mechanical robustness of good wear resistance to withstand the frictional action against these belt module support components.

But from imaging member manufacturing point of view, the addition of an ACBC in the flexible imaging member incurs material cost, adds labor involvement, and also reduces daily imaging member product throughput too, so efforts devoted to ACBC elimination has been pursued. In the most recent negatively charged flexible electrophotographic imaging member re-design break through, structurally simplified imaging member designs (with the elimination of ACBC) have been successfully created and demonstrated through CTL plasticizing approach. In these structurally simplified imaging member belts, incorporation of a high boiler liquid plasticizer into the CTL of the negatively charge imaging member belt helps to effect reduction of CTL dimensional contraction differential between the CTL and the flexible substrate support which thereby relieving the internal tension stress/strain build-up in the CTL to minimize the degree of the imaging member curl-up. In likewise manner, the ground strip layer is also incorporated with a plasticizer same as that used in the CTL to complement the imaging member curl control effect.

Although plasticizing both the CTL and the ground strip layer is seen to give a structurally simplified imaging member (without ACBC) of substantially flat or nearly flat configuration, but plasticizing both these layers is still yet unable to effect total curl control to render the ACBC-free imaging member desirable flatness the stringent imaging member belt flatness requirement for high volume electrophotgraphic imaging machines or printers. However, more problematically is that since the substrate support becomes the bottom exposed layer, it has been found that without an ACBC coverage for protection, the substrate support is very susceptible to mechanical friction action against the belt module support rollers and backer bars, under a dynamic imaging member belt cyclic machine functioning condition in the field, causing premature onset of wear/scratch failure to cut short the ACBC-free imaging member belt's service life.

Plasticized Charge Transport Layer and Ground Strip Layer of the Present Disclosure To minimize the dimensional thermal contraction mismatched magnitude between the CTL 20 and the support substrate 10, liquid plasticizer is then incorporated into the CTL 20 to effect $Tg_{CTL}$ lowering for internal strain $\epsilon$ reduction and give successful imaging member curl suppression result in accordance to equation (1). The selection of viable plasticizer(s) for CTL incorporation has to meet the requirements of: (a) high boiler liquids with boiling point exceeding 250° C. to insure its permanent presence, (b) completely miscible/compatible with both the polymer binder and the charge transport component such that its incorporation into the CTL material matrix cause no deleterious photoelectrical function of the resulting imaging member, and (c) be able to maintain the optical clarity of the prepared plasticized CTL for effecting electrophotographic imaging process. In the same manner, the ground strip layer 19 adjacent to CTL 20 is likewise plasticized to provide complementary imaging member curl control. Therefore, plasticizer incorporation into both the CTL 20 and the ground strip layer 19 to provide internal stress/strain reduction in these layers for curl control, the resulting imaging member as obtained is a simplified structure (having the elimination of ACBC 1 from that shown in FIG. 1) and gives a substantially flat configuration.

Plasticized CTL and plasticized ground strip are described in U.S. patent application Ser. Nos. 12/762,257; 12/782,671; and 12/216,151, the entire disclosures of which are hereby incorporated by reference. The thickness of the plasticized CTL 20 (being a single, dual, or multiple layered CTLs) after drying is from about 10 micrometers to about 40 micrometers or from about 14 micrometers to about 36 micrometers for optimum photoelectrical and mechanical results. The plasticized CTL 20 typically has a Young's Modulus in the range of from about $2.5\times10^5$ psi ($1.7\times10^4$ Kg/cm$^2$) to about $4.5\times10^5$ psi ($3.2\times10^4$ Kg/cm$^2$) and a thermal contraction coefficient of between about $6\times10^{-5}$/° C. and about $8\times10^{-5}$/° C.

It is important to point out that plasticizing both the CTL and the ground strip layer does produce a structurally simplified imaging member (without ACBC) of substantially flatness configuration, but plasticizing both these layers does not effect total curl control to render the resulting ACBC-free imaging member absolute flatness to meet high volume xerographic machines or printers requirement.

In addition to the success of CTL plasticizing, further effort of ground strip layer plasticization is also pursued to likewise provide supplemental imaging member curl control. Referring back to FIG. 1, the amount of plasticizer incorporation into each of the CTL 20 or the ground strip layer 19 is between about 5 and about 20 weight percent, or between about 8 and about 12 weight percent based on the total weight of each respective plasticized layer. The typical thickness of a plasticized CTL 20 (being a single, dual, or multiple layered CTLs) after drying is from about 10 micrometers to about 40 micrometers or from about 15 micrometers to about 35 micrometers for optimum photoelectrical and mechanical results. The plasticized CTL 20, utilizing a polycarbonate, such as for example, the bisphenol A polycarbonate binder, has a Young's Modulus in the range of from about $2.5\times10^5$ psi ($1.7\times10^4$ Kg/cm$^2$) to about $4.5\times10^5$ psi ($3.5\times10^4$ Kg/cm$^2$), and a thermal contraction coefficient of between about $5\times10^{-5}$/° C. and about $12\times10^{-5}$/° C.

The Conventional Overcoat Layer

Referring to FIG. 1, the imaging member may also include, for example, an optional over coat layer 32. An optional overcoat layer 32, if desired, may be disposed over the charge transport layer 20 to provide imaging member surface protection as well as improve resistance to abrasion. Therefore, typical overcoat layer is formed from a hard and wear resistance polymeric material. In embodiments, the overcoat layer 32 may have a thickness ranging from about 0.1 micrometer to about 10 micrometers or from about 1 micrometer to about 10 micrometers, or in a specific embodiment, about 3 micrometers. These over-coating layers may include thermoplastic organic polymers or inorganic polymers that are electrically insulating or slightly semi-conductive. For example, overcoat layers may be fabricated from a dispersion including a particulate additive in a resin. Suitable particulate additives for overcoat layers include metal oxides including nano particles of aluminum oxide, non-metal oxides including silica or low surface energy polytetrafluoroethylene (PTFE), and combinations thereof. Suitable resins for use include those described in the preceding for photogenerating layers and/or charge transport layers, for example, the A-B diblock copolymer, polyvinyl acetates, polyvinylbutyrals, polyvinylchlorides, vinylchloride and vinyl acetate copolymers, carboxyl-modified vinyl chloride/vinyl acetate copolymers, hydroxyl-modified vinyl chloride/vinyl acetate copolymers, carboxyl- and hydroxyl-modified vinyl chloride/vinyl acetate copolymers, polyvinyl alcohols, polycarbonates, polyesters, polyurethanes, polystyrenes, polybutadienes, polysulfones, polyarylethers, polyarylsulfones, polyethersulfones, polyethylenes, polypropylenes, polymethylpentenes, polyphenylene sulfides, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly-N-vinylpyrrolidinones, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and combinations thereof. Overcoating layers may be continuous and have a thickness of at least about 0.5 micrometer, or no more than 10 micrometers, and in further embodiments have a thickness of at least about 2 micrometers, or no more than 6 micrometers.

Plasticized Anti-Curl Back Coating of the Present Disclosure

Even though the effort of plasticizer incorporation into both the CTL 20 and the ground strip layer 19 is successful to provide the benefits: of rendering the imaging member belt curl suppression for ACBC elimination, photoelectrical property stability, and the prevention of early onset of fatigue CTL cracking as well for effecting belt service life extension in the field; nonetheless, the gains of elimination the ACBC in this imaging member has been found to create two undesirable problems; they are: (1) Exposure of the substrate support 10 (without the protection of an ACBC) to the sliding contact friction against the components (such as belt support rollers and backer bars) of imaging member belt support module during xerographic imaging process causes development of early onset of substrate wear failure under a normal machine usage condition; that is the substrate support wear-off becomes debris and dust to contaminate machine cavity and impede electrophotographic imaging process and function. (2) The nearly flat or substantially flatness configuration of imaging member belt, without an ACBC 1 provided through plasticizing the CTL 20, is still not adequately sufficient to meet the need of high volume electrophotographic imaging machines using a large 10-pitch imaging member belt, because these machines do require belt flatness for effecting proper imaging member belt dynamic cyclic function.

So to maintain all the benefits offered by having a plasticized CTL in the imaging member having a layered configuration of FIG. 1, but without the associated issues described above, a plasticized ACBC 1 is re-formulated according to the descriptions of this disclosure and applied over the back side of the substrate 10 for wear protection and rendering imaging member flatness to meet the specifically stringent belt flatness need in those high volume machines. The disclosed plasticized ACBC 1 may comprise one or more of a film forming polymer, a liquid plasticizer, a copolyester adhesion promote, and may also include organic or inorganic particles dispersion in its material matrix to impact scratch wear enhancement as well as rendering imaging member flatness.

Typical film forming polymers selected for preparation of the disclosed plasticized ACBC 1 reformulation may be of the same or different one from that used in the plasticized CTL 20. Non-limiting examples of the film forming polymers selected for embodiments preparation of the disclosed plasticized ACBC 1 reformulation may include a high molecular weight film forming A-B diblock copolymer polycarbonate. having a generic formula represented by Formula I below:

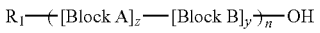

Formula I wherein block A is a carbonate repeating unit, block B is an organic acid containing repeating unit, z represents the number of carbonate repeating units of block A and is, for example, from about 9 to about 18, from about 27 to about 36, or from about 45 to about 54, y represents the number of organic acid containing repeating units of block B and is, for example, from about 1 to about 6, or from about 1 to about 2, n represents the degree of polymerization of the A-B diblock copolymer, which can be between about 20 and about 80, between about 30 and about 70, or between about 40 and about 60, $R_1$ is H or $CH_3$. The copolymer typically has a weight average molecular weight of between about 80,000 and about 250,000 or between about 100,000 and about 200,000, or between about 110,000 and about 150,000.

The film forming A-B diblock copolymer used for ACBC formulation of present disclosure is a polycarbonate derived from different types of polycarbonates and by the inclusion of small fraction from one of different dicarboxylic acids into the polymer backbone, and the resulting copolymer contains from about 98 mole percent to about 80 mole percent, or from about 95 mole percent to about 85 mole percent of a carbonate segmental block A linearly linking to from about 2 mole percent to about 20 mole percent or from about 5 mole percent to about 15 mole percent of a segmental block B containing of a dicarboxylic acid terminal in the A-B diblock copolymer chain. In specific embodiments, the resulting copolymer contains about 90 mole percent of a segment block A linearly linking to about 10 mole percent of a segmental block B of an acid terminal in the A-B diblock copolymer chain.

The polycarbonate segment block A of the A-B diblock copolymer has the following structure:

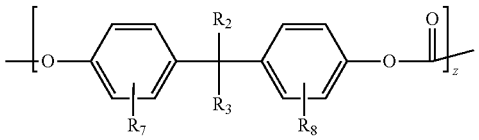

wherein each $R_2$, $R_3$ is independently H or lower $C_1$-$C_3$ alkyl, or $R_2$ and $R_3$ taken together with the C atom to which they are attached form an alkylcyclic ring, where any ring atom of the alkylcyclic ring may be optionally substituted with an alkyl; each $R_7$, $R_8$ is independently H or lower $C_1$-$C_3$ alkyl; and z is between about 9 and about 18, between about 27 and about 36, or between about 45 and about 54. In certain embodiments, each of $R_2$, $R_3$ is methyl, or $R_2$ and $R_3$ taken together with the C atom to which they are attached form a cyclohexane, where any ring atom of the cyclohexane may be optionally substituted with one or more methyl. In certain embodiments, each of $R_7$, $R_8$ is H or each of $R_7$, $R_8$ is methyl.

The segment block B of the A-B diblock copolymer has the following structure:

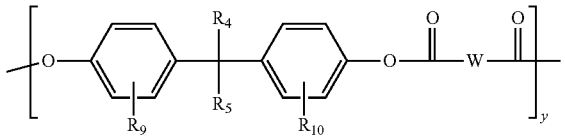

wherein each $R_4$, $R_5$ is independently H or lower $C_1$-$C_3$ alkyl, or $R_4$ and $R_5$ taken together with the C atom to which they are attached form an alkylcyclic ring, where any ring atom of the alkylcyclic ring may be optionally substituted with an alkyl; each $R_9$, $R_{10}$ is independently H or a lower $C_1$-$C_3$ alkyl; and y is between about 1 and about 2. In certain embodiments, each of $R_4$, $R_5$ is methyl, or $R_4$ and $R_5$ taken together with the C atom to which they are attached form a cyclohexane, where any ring atom of the cyclohexane may be optionally substituted with one or more methyl. In certain embodiments, each of $R_9$, $R_{10}$ is H or each of $R_9$, $R_{10}$ is methyl.

In specific embodiments, the film forming A-B diblock copolymer used for ACBC formulation of present disclosure is a polycarbonate derived from the bisphenol A polycarbonate structure by the inclusion of small fraction of dicarboxylic acid into the polymer backbone, and the resulting copolymer contains about 90 mole percent of a bisphenol A segment block A linearly linking to about 10 mole percent of a segmental block B of dicarboxylic acid terminal in the A-B diblock copolymer chain. Exemplary polycarbonates (Block A) include the following carbonates:

Formula A-1

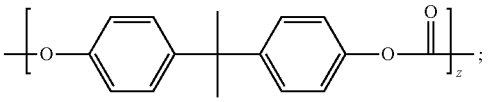

(bisphenol A carbonate)

Formula A-2

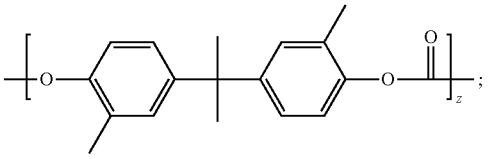

Formula A-3

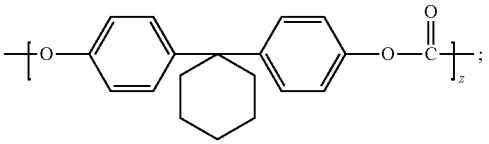

Formula A-4

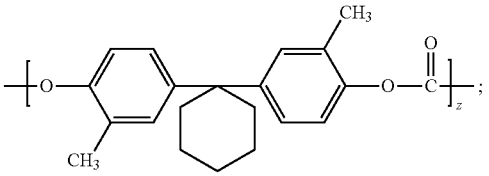

Formula A-5

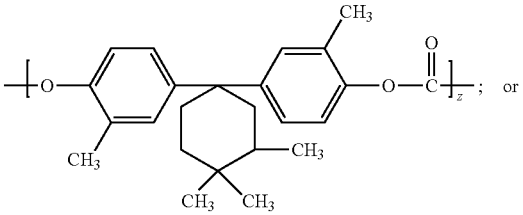

Formula A-6

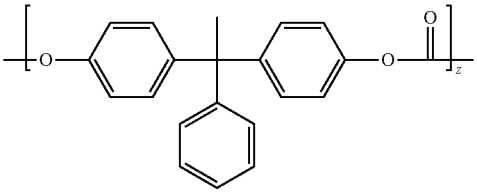

wherein z is an integer representing the numbers of repeating segmental carbonate unit, is from about 9 to about 18, from about 27 to about 36, or from about 45 to about 54.

The acid terminal units (Block B) have the following structures:

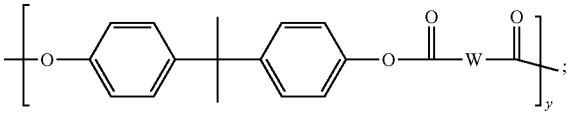

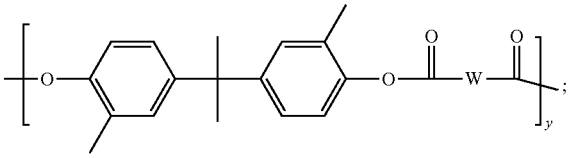

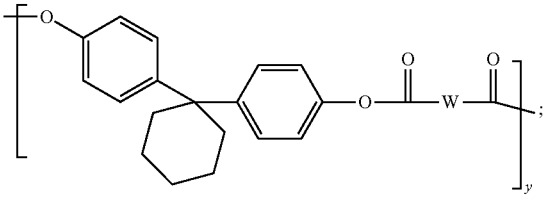

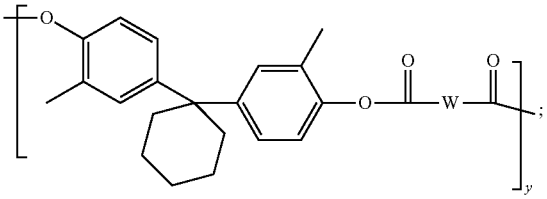

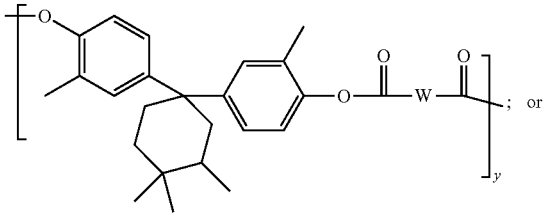

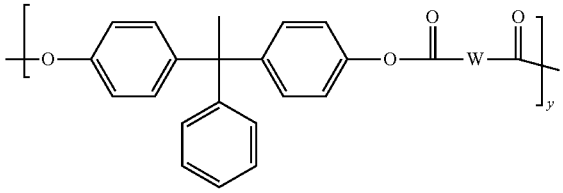

wherein W is an aromatic moiety or an aliphatic moiety, and y is from about 1 to about 6. In certain embodiments, W is an aryl having from 6 to 36 carbon atoms, or from 6 to 24. In certain of such embodiments, W is a phenyl. In certain embodiments, W is an alkylene having from 2 carbon atoms to 10 carbon atoms, from about 3 to about 8 carbons, or from 4 to 6 carbons.

In certain of such embodiments, the dicarboxylic acid terminal units have the following structures:

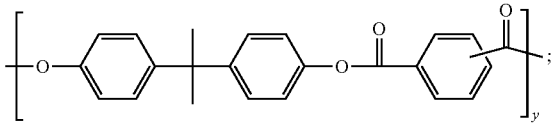

-continued
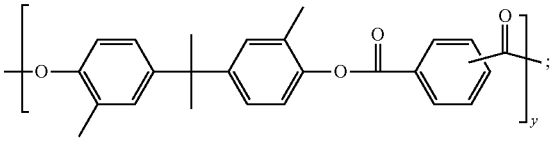
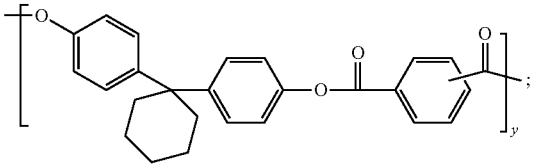
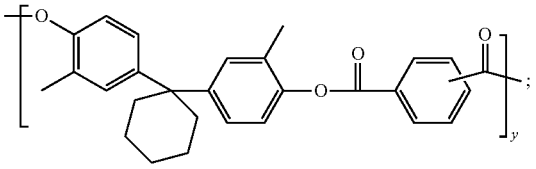
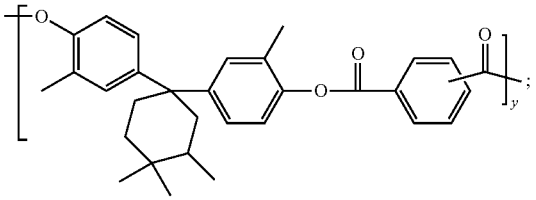
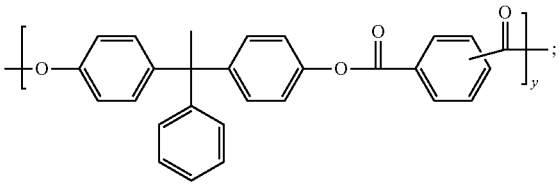
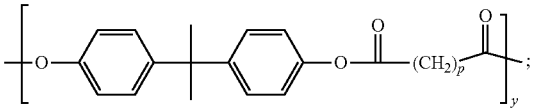
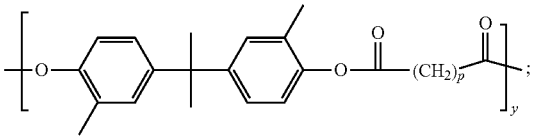
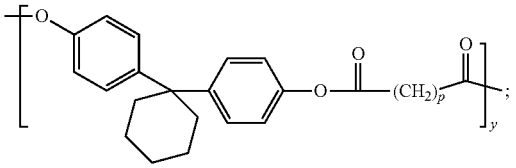
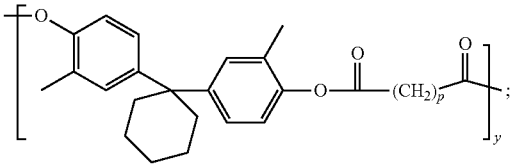
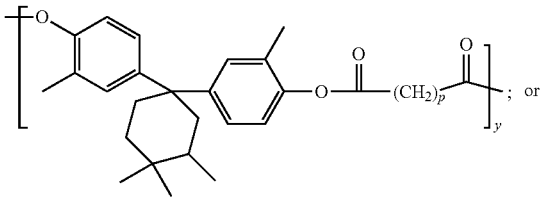
; or
-continued
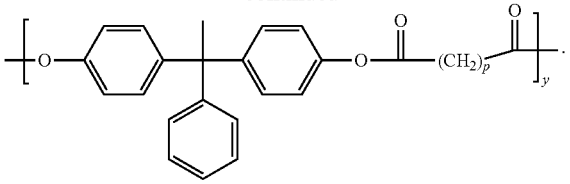
wherein p is from 3 to 8 or from 4 to 6; and y is from about 1 to about 6.
In yet certain of such embodiments, the dicarboxylic acid terminal units have the following structures:
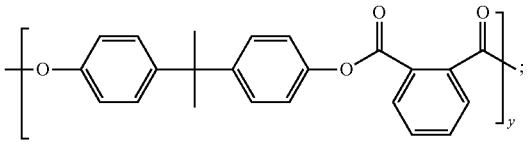
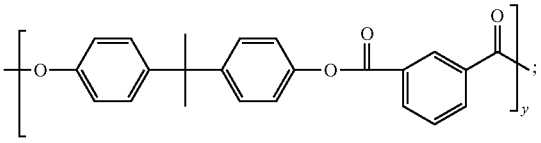
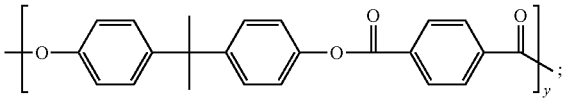
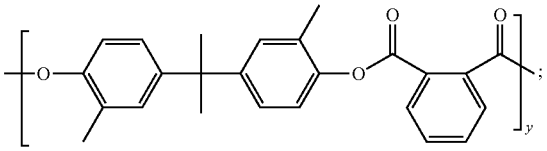
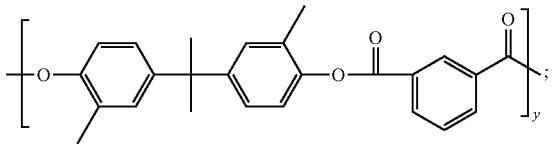
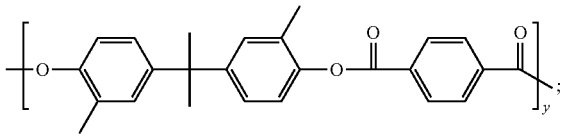
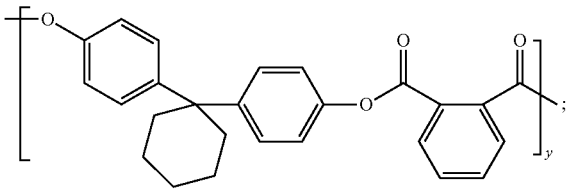
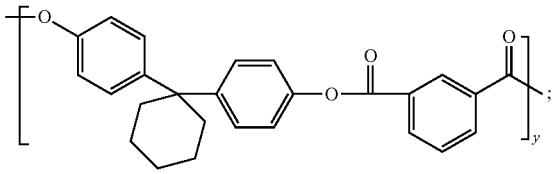
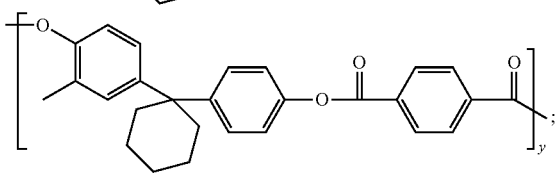

-continued
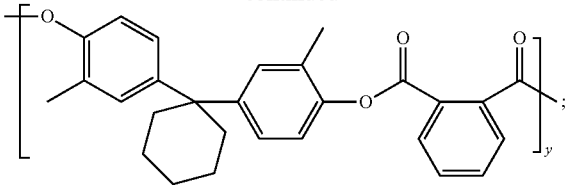
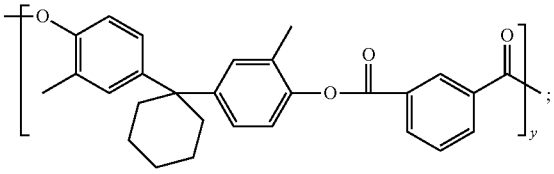
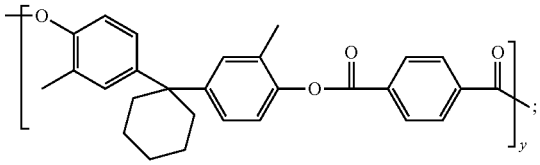
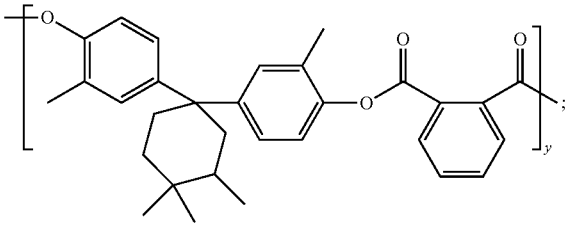
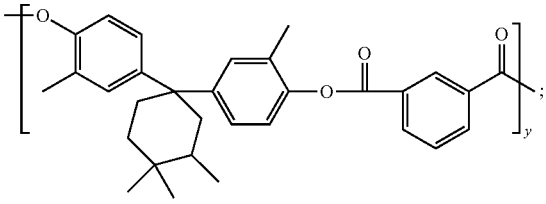
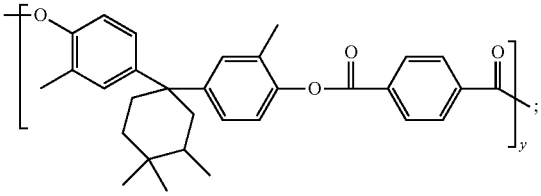
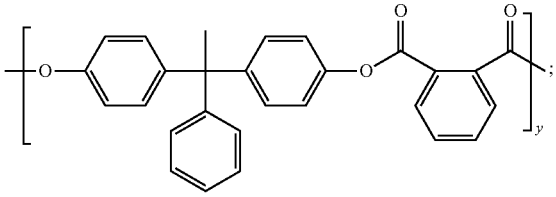
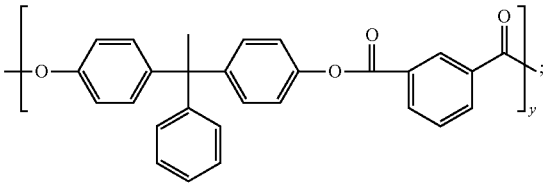
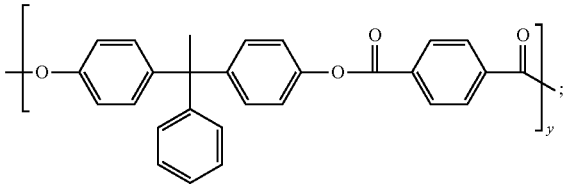
-continued
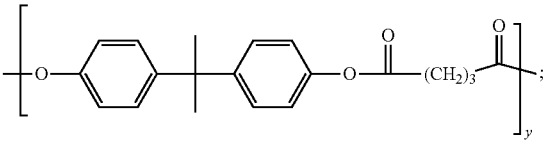
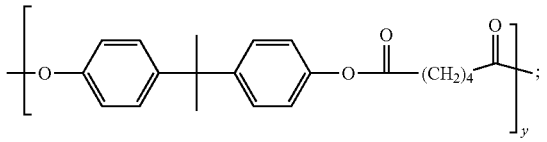
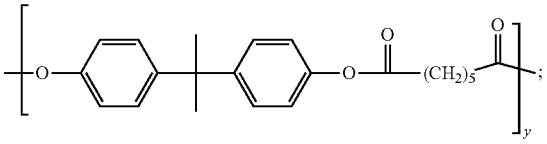
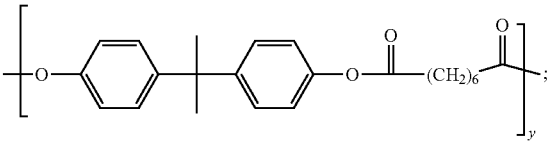
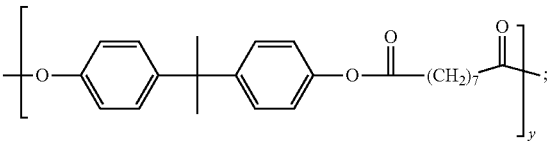
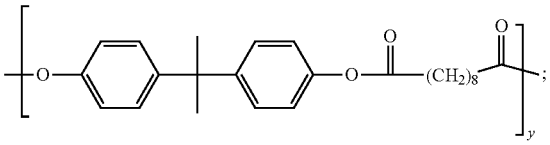
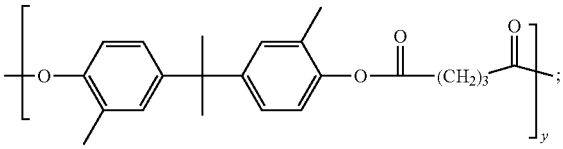
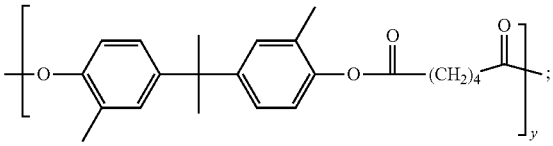
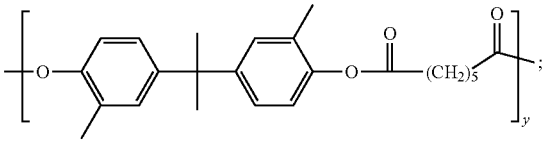
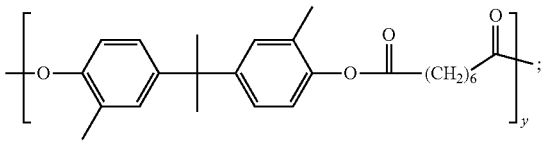
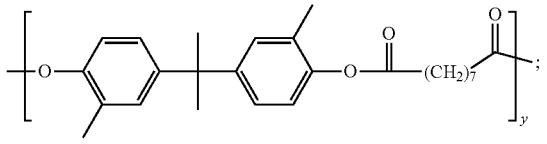
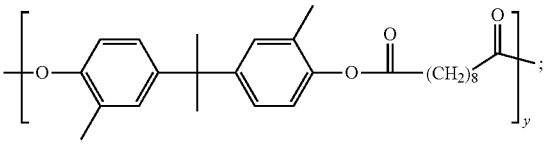

-continued
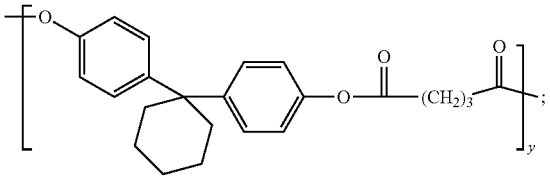
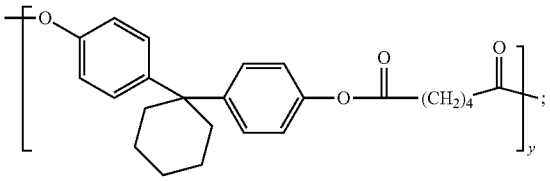
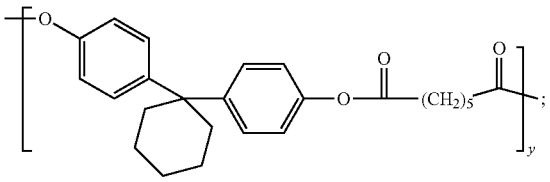
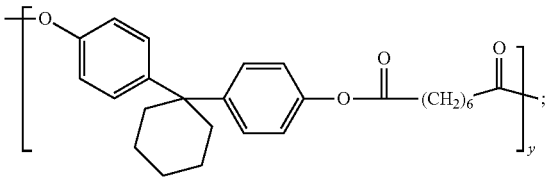
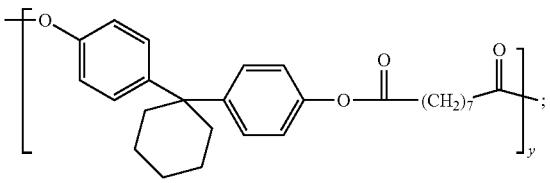
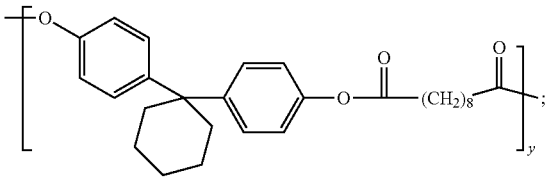
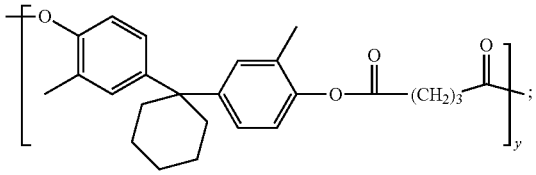
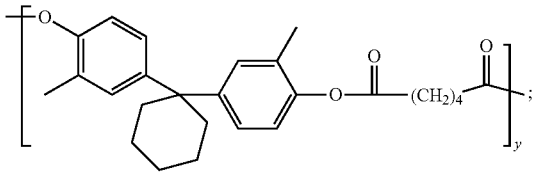
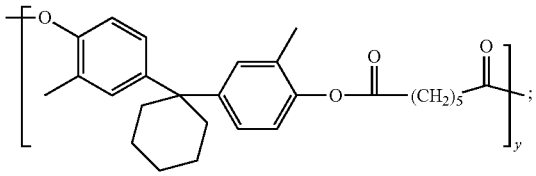
-continued
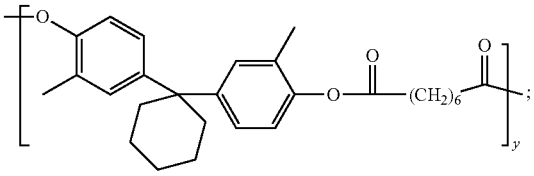
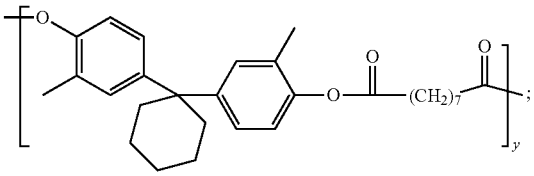
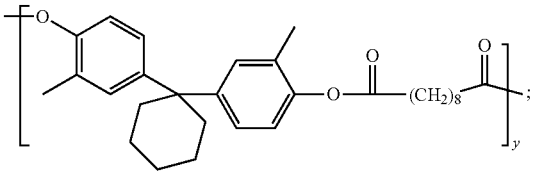
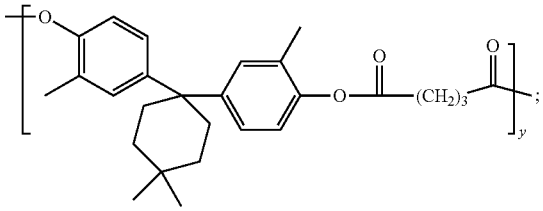
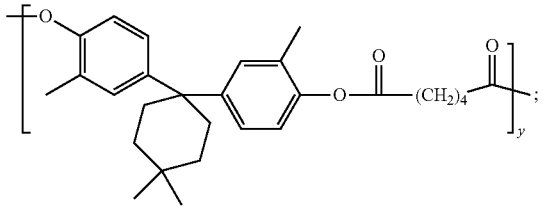
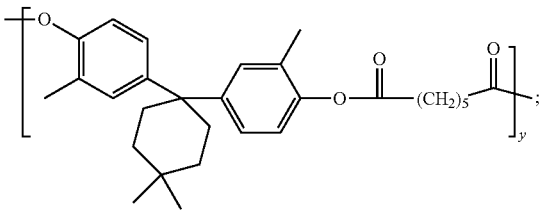
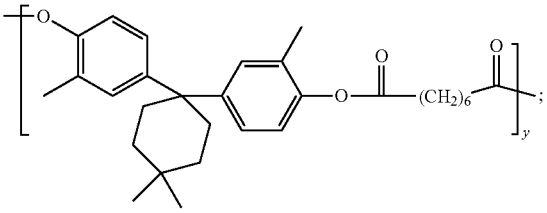
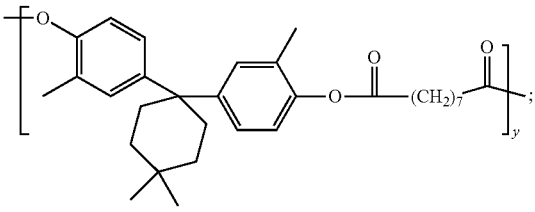

-continued

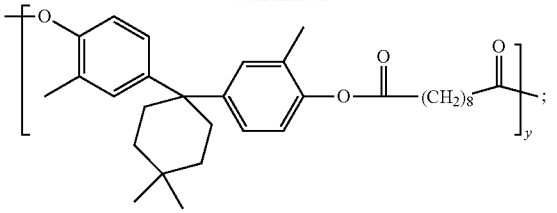

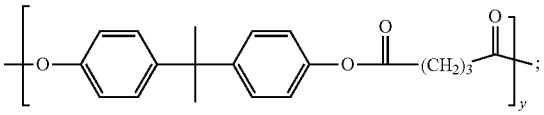

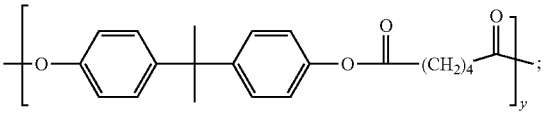

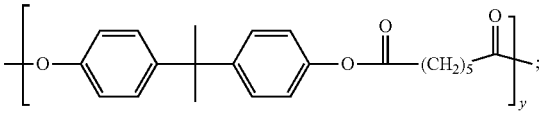

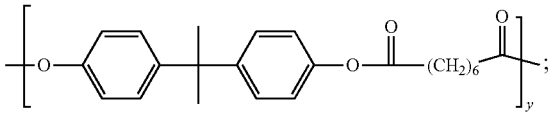

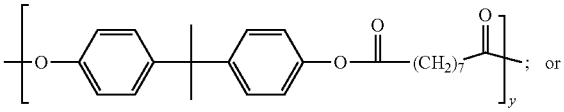

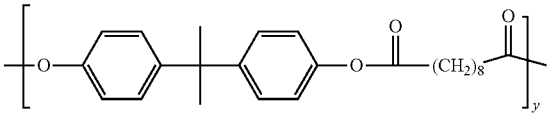

wherein y is 1 to 6.

In specific embodiments, the dicarboxylic acid segment in Block B may be derived from an aromatic dicarboxylic acid such as a phthalic acid, an terephthalic acid, an isophthalic acid, or derived from an aliphatic acid such as an glutaric acid, adipic acid, heptanedioic acid, octanedioic acid, azelaic acid, decanedioic acid, and the like as shown below:

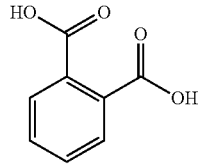

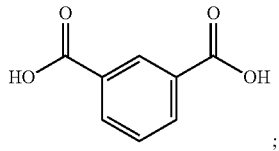

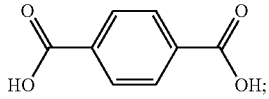

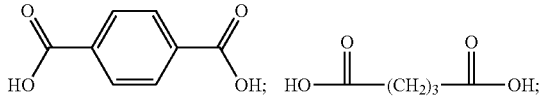

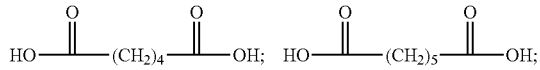

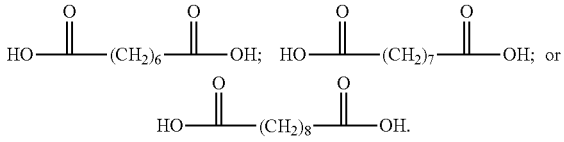

In certain embodiments, the A-B diblock copolymer has a structure of Formula II:

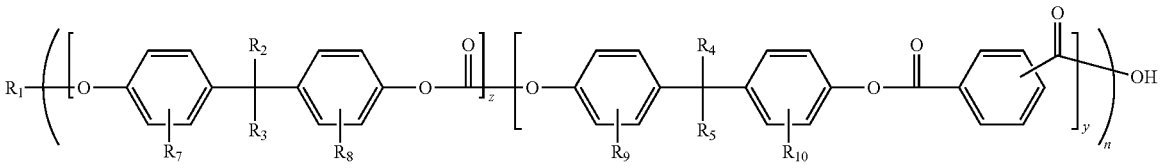

wherein the Block A and Block B are independently selected from the above lists described in the disclosure herein.

In certain embodiments, the A-B diblock copolymer has a structure of Formula III:

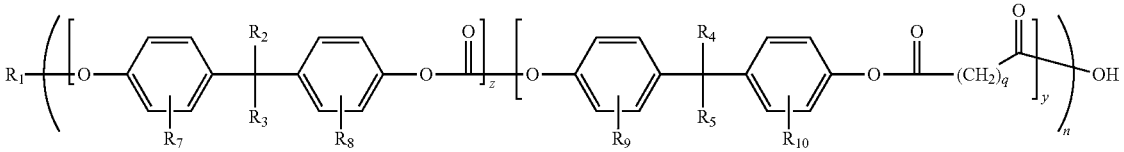

wherein the Block A and Block B are independently selected from the above lists described in the disclosure herein. $R_1$ to $R_5$ and $R_7$ to $R_{10}$ are defined in the present embodiments.

Those skilled in the art will recognize that A-B diblock copolymer discloses specific structures as if the combinations were individually drawn out. By way of illustration, specific examples of the compounds of this embodiment as disclosed above in the A-B diblock copolymer are as follows.

Block A selected from Formula A-4 and block B selected from the dicarboxylic acid terminal unit having the following structure:

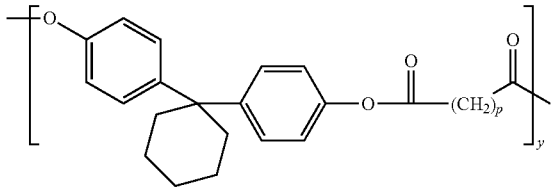

wherein p is 4, and Y is 1 to 6 together combine to form the following two A-B diblock copolymers:

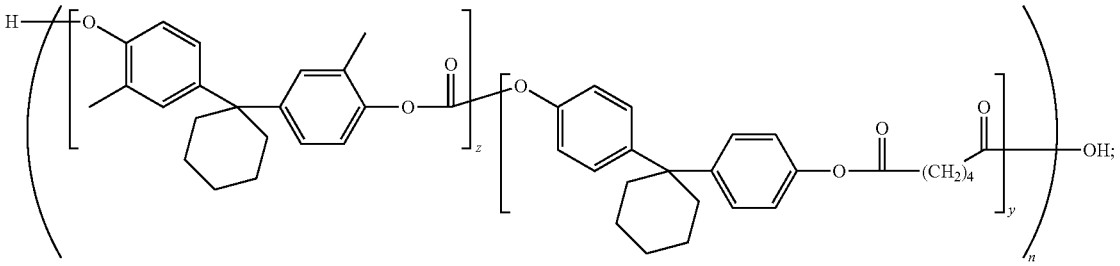

and

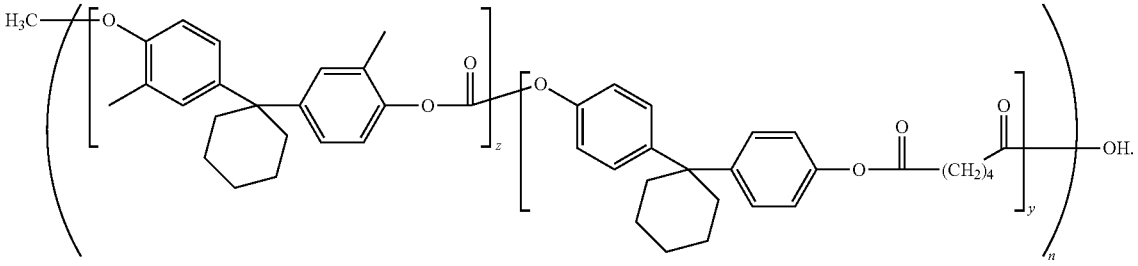

wherein y is 1 to 6, z is 9 to 54, and n is between about 20 and about 80.

Block A selected from Formula A-2 and block B selected from the dicarboxylic acid terminal unit having the following structure:

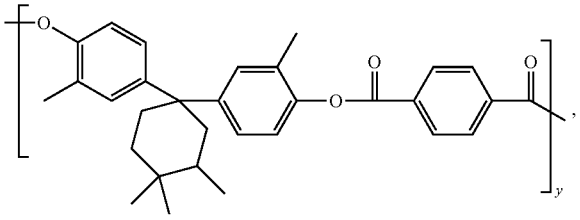

together combine to form the following two A-B diblock copolymers, wherein y is 1 to 6:

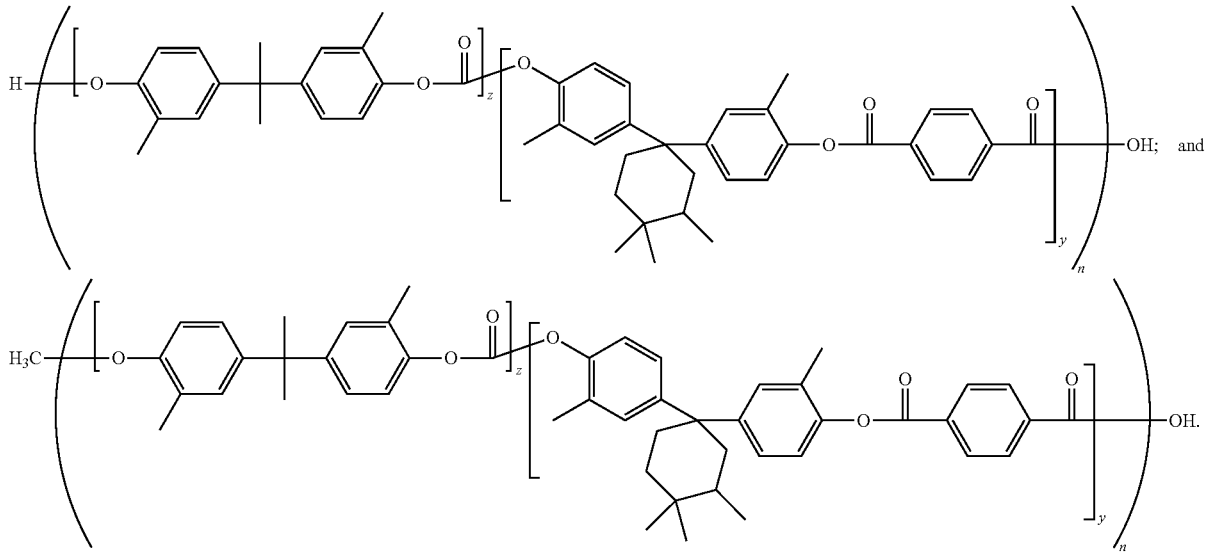

wherein y is 1 to 6, z is 9 to 54, and n is between about 20 and about 80.

In certain embodiments, the flexible imaging member comprises a mixture of one or more copolymer (or A-B diblock copolymer) described in the disclosure.

In specific embodiments, the flexible imaging member comprises a copolymer of Formula 1, or Formula 2, or a mixture thereof:

Formula 1

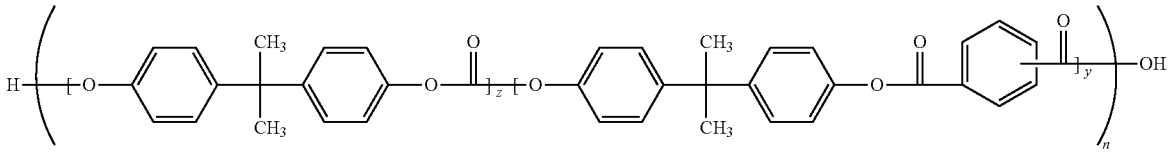

Formula 2

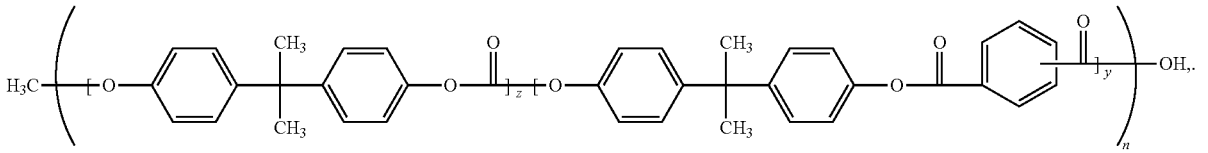

wherein z represents the number of bisphenol A polycarbonate repeating units in segmental Block A of from about 9 to about 18; y is number of repeating phthalic acid unit in segmental Block B of from about 1 to about 2; and n is the degree of polymerization of between about 20 and about 80 for the copolymer having a weight average molecular weight between about 80,000 and about 250,000, and mixtures thereof, The high molecular weight A-B diblock copolymer is then incorporated with a plasticizer in the process of preparing the plasticized ACBC 1 of this disclosure. Even though the liquid plasticizer suitable for use to plasticize the ACBC 1 may be different from the liquid plasticizer in the CTL 20, but it is preferred to be of the same one. The selected liquid plasticizers are high boiler having a boiling point of at least 250° C. to insure permanent presence in the reformulated ACBC; they include (1) organic liquid plasticizers such as phthalates and bisphenol liquids, (2) liquid oligomeric styrenes, or derivatives thereof, such as low molecular weight polystyrenes, and (3) fluoro-containing organic liquids which are capable of lowering the surface energy to render slipperiness of the formulated ACBC.

Organic Liquid Plasticizers

Organic liquid plasticizers having the generic following formula:

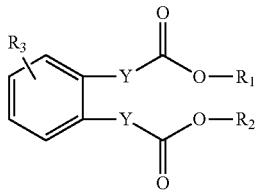

wherein Y is O or null; each $R_1$ and $R_2$ is independently $C_1$-$C_6$ alkyl or $R_1$ and $R_2$ taken together with the O atom of the ester groups to which they are attached and part of the benzene ring form a heterocyclic ring; $R_3$ is H or —C(O)$OR_4$, and $R_4$ is $C_1$-$C_6$ alkyl. In certain embodiments, each $R_1$, $R_2$ and $R_4$ is independently methyl, ethyl, propyl or butyl.

Non-limiting exemplary phthalates include the following

Formula (I)

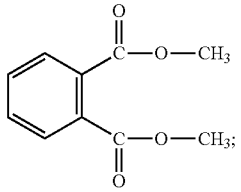

Formula (IA)

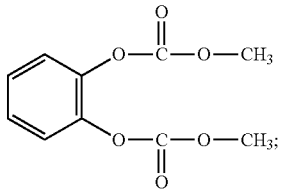

Formula (II)

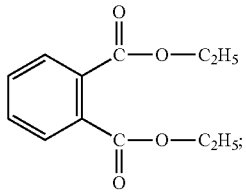

Formula (IIA)

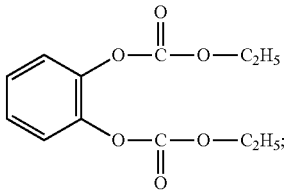

-continued

Formula (III)

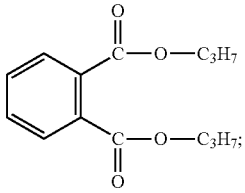

-continued

Formula (IV)

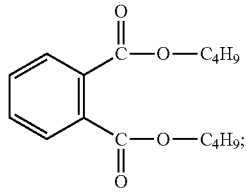

Formula (V)

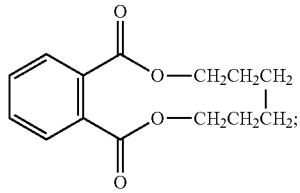

Formula (VI)

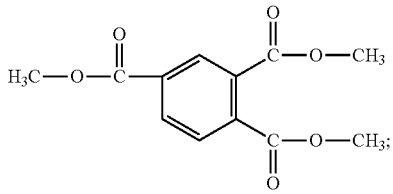

Formula (VII)

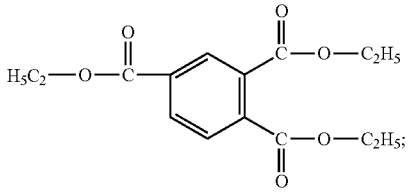

and mixtures thereof.

Non-limiting exemplary monomeric carbonates include the following:

Formula (1)

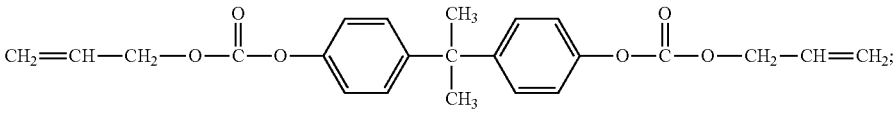

Formulas (2) to (5) may be conveniently derived from Formula (1):

Formula (2)

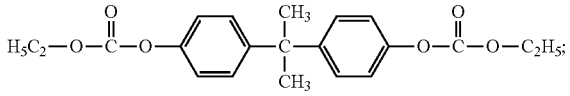

Formula (3)

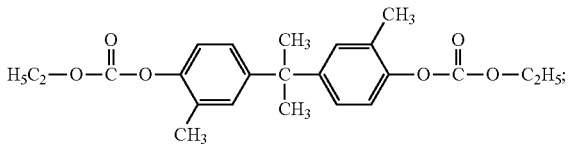

-continued

Formula (4)

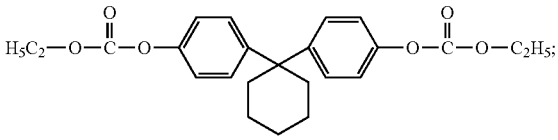

Formula (5)

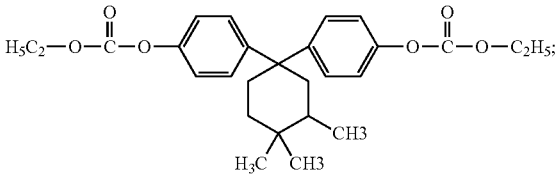

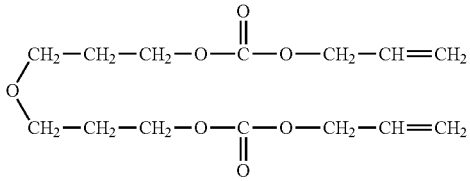

Diethylene glycol bis(allyl carbonate) Formula (6); and mixtures thereof.

Liquid Oligomeric Styrenes

Non-limiting exemplary styrenes include the following:

Formula (B)

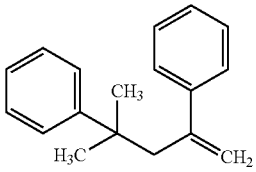

Non-limiting exemplary low molecular weight liquid polystyrenes include the following:

Formula (A)

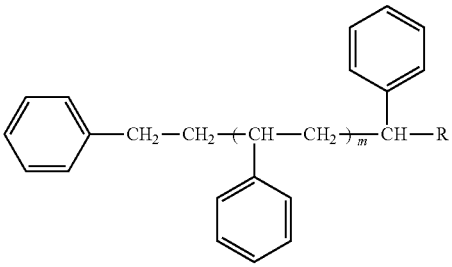

wherein R is selected from the group consisting of H, $CH_3$, $CH_2CH_3$, and $CH{=}CH_2$, and where m is between 0 and 3.

Fluoro-containing Organic Liquids

The fluoro-containing organic liquids render plasticizing effect for eliminating the CTL/ground strip layer internal stress/strain build-up for curl control, and provides surface energy reduction effect to impact surface slipperiness enhancement in the resulting CTL/ground strip layer. The same fluoro-containing organic liquids may be used in the ACBC. The fluoro-organic liquids include fluoroketones having the formula:

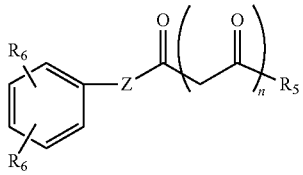

wherein $R_5$ is $C_1$-$C_6$ alkyl, perhaloalkyl, or haloalkyl; Z is null or alkylene; n is 0 or 1; $R_6$ is H, $C_1$-$C_6$ alkoxy, perhaloalkyl, or haloalkyl.

Non-limiting examples fluoroketones are 3-(trifluoromethyl)phenylacetone, 2'-(trifluoromethyl)propiophenone, 2,2,2-trifluoro-2',4'-dimethoxyacetophenone, 3',5'-bis(trifluoromethyl)acetophenone, 3'-(trifluoromethyl)propiophenone, 4'-(trifluoromethyl)propiophenone, 4,4,4-trifluoro-1-phenyl-1,3-butanedione, 4,4-difluoro-1-phenyl-1,3-butanedione, and the like. The structures of these fluoroketones are shown below:

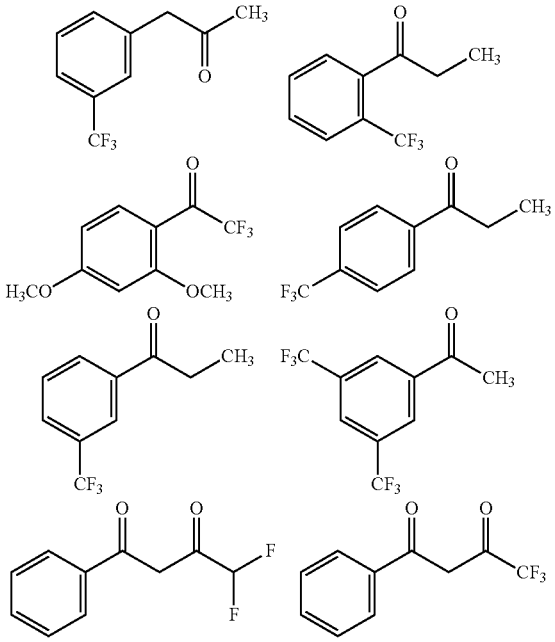

In essence, the plasticized ACBC 1 reformulated in accordance to the descriptions of present disclosure is comprised of an A-B diblock copolymer and a plasticizer. However, a copolyester adhesion promoter may also be included to enhance the ACBC 1 adhesion bonding strength to the support substrate 10. Non-limited specific examples of the copolyester adhesion promoters for addition to the plasticized ACBC 1 is a linear saturated polymer of four diacids and ethylene glycol and having a general molecular structure represented in the following:

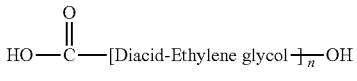

One example is copolyester 49,000 resin (available from Rohm and Haas), having a weight average molecular weight (Mw) of about 70,000 and a 1:1 mole ratio of diacid to ethylene glycol; the diacids are terephthalic acid, isophthalic acid, adipic acid, and azelaic acid in a mole ratio of 4:4:1:1.

Another example of an adhesion promoter is copolyester Vitel PE 100 (from Bostik Inc.), having a Mw of about 50,000 and a 1:1 mole ratio of diacid to ethylene glycol; the diacids are terephthalic acid and isophthalic acid in a mole ratio of 3:2.

One alternative linear saturated copolyester adhesion promoter is Vitel PE 200 (from Bostik Inc.), having a Mw of about 45,000 and a molecular structure shown below:

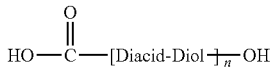

The mole ratio of diacid to diol in the copolyeater is 1:1 and the diacids are terephthalic acid and isophthalic acid in a mole ratio of 1.2:1. The two diols are ethylene glycol and 2,2-dimethyl propane diol in a mole ratio of 1.33:1.

For the above structures, n is the degree of polymerization of the copolyester and generally can be any positive integer calculated from the weight average molecular weight of the specific copolyester. The effective amount of an adhesion promoter presence in the ACBC is in a weight ratio of polycarbonate to copolyester adhesion promoter of from about 80:20 to about 99:1, from about 85:15 to about 95:5 or about 90:10.

Therefore, in all the plasticized ACBC 1 disclosed in the imaging member embodiments described above, the amount of plasticizer incorporated is from about 5 to about 20 weight percent, from about 8 to about 16 weight percent, or from about 12 to about 16 weight percent; whereas the amount of adhesion promoter added is from about 1 to about 15 weight percent, from about 3 to about 10 weight percent, or from about 5 to about 8 weight percent, based on the total weight of the resulting plasticized ACBC formulation.

In certain embodiments of present disclosure, though the liquid plasticizer selected to plasticize the anti-curl back coating described herein is different but preferably to be the exact same one comprised in the plasticized CTL; in such instance, this plasticizing liquid is miscible with both the polycarbonate and the charge transport compound in the CTL.

It is important that the plasticized ACBC 1 has mechanical and thermal properties such as Young's Modulus of from about $2.5\times10^5$ psi ($1.7\times10^4$ Kg/cm$^2$) to about $4.5\times10^5$ psi ($3.5\times10^4$ Kg/cm$^2$) and a thermal contraction coefficient of between about $5\times10^{-5}$/° C. and about $12\times10^{-5}$/° C. about equivalent to those of the plasticized CTL 20 to achieve good curl control, and to render flatness for the imaging member containing a plasticized CTL 20 shown in FIG. 1, the plasticized ACBC 1 thickness is from about 5 micrometers to about 40 micrometers. In very specific embodiments, the plasticized ACBC 1 is required to have a thickness of between about 10 micrometers and about 20 micrometers for achieving imaging member flatness when the plasticized CTL 20 of the imaging member has a thickness of from about 20 to 35 micrometers.

It is also important that the plasticized ACBC 1 reformulated according to this disclosure has suitable optically transmittance (e.g., transparency), so that the residual voltage remaining after completion of a photoelectrical imaging process on the imaging member surface can conveniently be erased by radiation illumination directed from the back side of the imaging member through the ACBC thickness of the imaging member during electrophotographic imaging processes.

In further imaging member embodiments of extended disclosure described herein after, an organic or inorganic particles dispersion of from about 5 to about 10 weight percent (based on the total weight of the resulting plasticized ACBC 1) may optionally be added into the plasticized ACBC 1 material matrix to boost its wear/scratch resistance. Suitable inorganic particulate additives suitable for dispersion use are, for example, the metal oxides of nano particles of metal oxide, non-metal oxides; metal oxides including nano particles of aluminum oxide, titanium dioxide, zirconium oxide, tin oxide; while non-metal oxides including silica, and combinations thereof.

Figure 2:
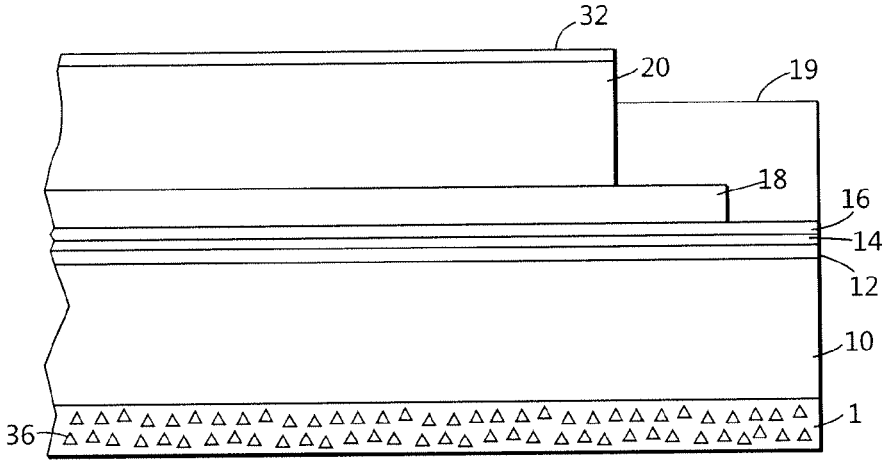
FIG. 2 is a schematic cross-sectional view of a second exemplary embodiment of a flexible imaging member having a plasticized CTL and a plasticized ACBC including inorganic particles dispersion in the ACBC prepared according to the present disclosure.

The organic particles are the low surface energy polytetrafluoroethylene (PTFE), fatty amides, waxy polyethylene, for example, one having a molecular formula $CH_3(CH_2)_m CH_3$, wherein m is between about 5 and about 15, a petrac oleamide having a molecular formula $CH_3(CH_2)_7CH{=}CH(CH_2)_7C{=}OCNH_2$, a petrac erucamide having a molecular formula $CH_3(CH_2)_7CH{=}CH(CH_2)_{11}C{=}OCNH_2$, and the like and mixtures thereof. For certain embodiments, the plasticized ACBC 1 may include an organic particle dispersion. As shown in FIG. 2, it illustrates a flexible multi-layered electrophotographic imaging member prepared to contain a plasticized CTL 20 and a plasticized ACBC 1 according to the exact same material formulations, compositions, layer dimensions, methodology, and procedures as those described in each of the embodiments described in FIG. 1, except that the disclosed plasticized ACBC 1 is included a dispersion of organic particles in its material matrix. That means the imaging members comprise the exact same substrate 10, conductive ground plane 12, hole blocking layer 14, adhesive interface layer 16, CGL 18, plasticized ground strip layer 19, plasticized CTL 20, plasticized ACBC 1, and an optional overcoat layer 32, but with the exception that the plasticized ACBC 1 in each imaging member is modified to incorporate homogeneous dispersion of organic particles 36 into its layer matrix to render sliding contact friction reduction for effecting scratch and wear resistance enhancement. The organic particles 36 dispersed in the plasticized ACBC 1 material matrix include, for example, polyterafluoroethylene (PTFE) available as ZONYL MP1100 and ZONYL MP1000 from E.I. du Pont de Nemours & company; waxy polyethylene having molecular formula $CH_3(CH_2)_mCH_3$, where m is between about 5 and about 15, available as ACUMIST from Allied-Signal, Inc.; Petrac Oleamide with a molecular formula $CH_3(CH_2)_7CH{=}CH(CH_2)_7C{=}OCNH_2$ available from synthetic Products company; and Petrac Erucamide with molecular formula $CH_3(CH_2)_7CH{=}CH(CH_2)_{11}C{=}OCNH_2$ available from synthetic Products company. The average particle size of the organic particle is from about 0.02 micrometer to about 3 micrometers, or from about 0.01 micrometer to about 2 micrometers. The organic particle is present in an amount of from about 1 to about 10 weight percent, or from about 4 to 8 weight percent based on the total weight of the resulting plasticized ACBC layer 1.

Figure 3:
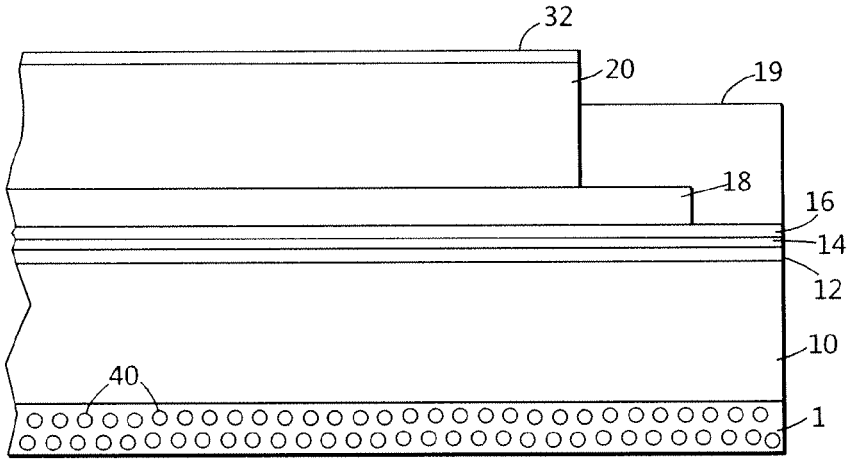
FIG. 3 is a schematic cross-sectional view of a third exemplary embodiment of a flexible imaging member, having a plasticized CTL and a plasticized ACBC including inorganic particles dispersion in the ACBC prepared according to the present disclosure.

In another certain embodiments, the plasticized ACBC 1 prepared as described in the imaging member of FIG. 2 may alternatively be replaced with an inorganic particle. Embodiments of flexible imaging members shown in FIG. 3 are likewise prepared according to the exact same material formulations, compositions, layer dimensions, methodology, and procedures as those described in each of the embodiments described in FIG. 2, but with the exception that the organic particles 36 dispersed in the plasticized ACBC 1 in each imaging member are being replaced by homogeneous inorganic particles dispersion 40 in its plasticized ACBC material matrix. The inorganic particles 40 are scratch/wear resistance hard particles such as, for example, microcrystalline silica available from Malvern Minerals Co., amorphous silica available from Degussa Corp., and various metal oxides such as aluminum oxide, titanium dioxide, Zirconium oxides, and the like. The average particle size of the inorganic particle is from about 0.02 micrometer to about 3 micrometers, or from about 0.01 micrometer to about 2 micrometers. The inorganic particle is present in an amount of from about 1 to about 10 weight percent, or from about 4 to 8 weight percent based on the total weight of the resulting plasticized ACBC layer 1.

Figure 4:
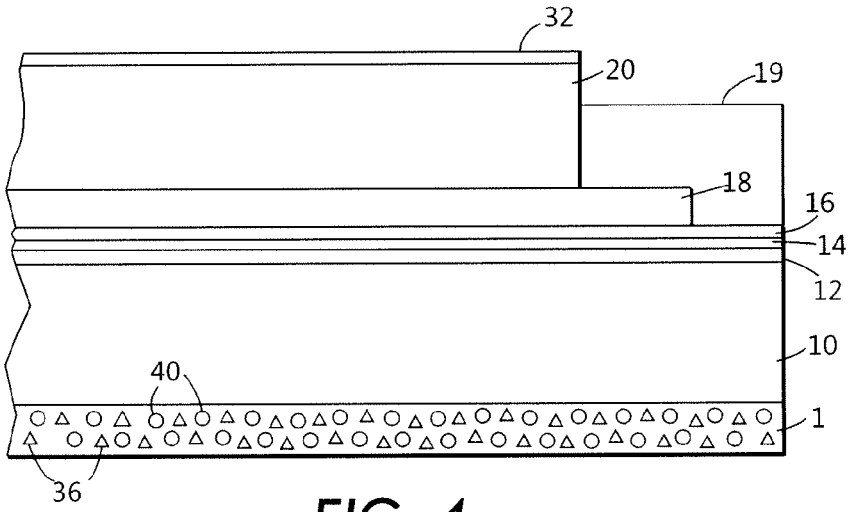
FIG. 4 is a schematic cross-sectional view of a fourth exemplary embodiment of a flexible imaging member having a plasticized CTL and a plasticized ACBC including a mixture of organic and inorganic particles dispersion in the ACBC prepared according to the present disclosure.

In yet another certain embodiments, the disclosed plasticized ACBC 1 may be prepared to include a mixture dispersion of an organic particle and an inorganic particle. Embodiments of flexible imaging members shown in FIG. 4 are likewise prepared according to the exact same material formulations, compositions, layer dimensions, methodology, and procedures as those described in each of the embodiments described in FIG. 1, but with the exception that the plasticized ACBC 1 includes homogeneous dispersion of binary mixture of organic particles 36 and inorganic particles 40 in the layer matrix to impart the dual benefits of sliding contact reduction and scratch/wear resistance enhancement. The weight ratio of the organic particles to the inorganic particles (in all combination variances) is from about 10:90 to about 90:10, from about 70:30 to about 30:70, or about 50:50. The binary mixture of organic/inorganic particles dispersion is present in an amount of from about 1 to about 10 weight percent or from about 4 to 8 weight percent based on the total weight of the resulting plasticized ACBC layer 1.

In recapitulation, the embodiments of flexible multi-layered imaging members containing a plasticized CTL 20 and having flatness, the plasticized ACBC 1 is reformulated to include an high molecular weight A-B diblock copopolymer, a copolyester adhesion promoter, a liquid plasticizer. In extended certain embodiments, the plasticized ACBC 1 is further reformulated to include organic or inorganic particles dispersion, or dispersion mixture thereof according to the detailed descriptions in each of the preceding embodiments of present disclosure.

In specific embodiments, the plasticized ACBC 1 includes from about 70 to about 80 weight percent A-B diblock copolymer, from about 5 to about 20 weight percent plasticizer, from about 1 to about 15 weight percent adhesion promoter, and from about 4 to about 8 weight percent organic or inorganic or 50:50 mixture organic/inorganic particles dispersion, based on the total weight of the resulting plasticized ACBC 1.

Typically, the plasticized ACBC 1 has a thickness of from about 5 micrometers to about 40 micrometers or from about 10 micrometers and 30 micrometers. In certain specific embodiments, the plasticized ACBC 1 reformulated to produce imaging member flatness has a thickness of from about 10 micrometers to about 20 micrometers for an imaging member containing a plasticized CTL 20 with a thickness of from 20 micrometers to about 35 micrometers. In essence, the thickness of a plasticized ACBC 1 depends on the thickness of the plasticized CTL 20. For instance, imaging member having a 29-micrometer plasticized CTL 20 (comprising 1:1 weight ratio of polycarbonate binder to diamine charge transport compound and 8 weight percent diethyl phthalate (DEP)plasticizer), a 12 weight percent DEP plasticized ACBC 1 of 17 micrometers thickness is needed to impact total curl control and render the required imaging member flatness.

In certain embodiments, plasticizer used in ACBC 1 may be different from but are preferably to be the same one as that in the CTL 20. The plasticized ACBC 1, having a Young's Modulus in the range of from about $2.5\times10^5$ psi ($1.7\times10^4$ Kg/cm$^2$) to about $4.5\times10^5$ psi ($3.5\times10^4$ Kg/cm$^2$), and a thermal contraction coefficient of between about $5\times10^{-5}$/° C. and about $12\times10^{-5}$/° C., in the reformulations disclosure according to such embodiments, are about equivalent to those of the plasticized CTL 20 to effect good curl control outcome.

It is also important that the plasticized ACBC 1 reformulated according to this disclosure has suitable optically transmittance (e.g., transparency), so that the residual voltage remaining after completion of a photoelectrical imaging process on the imaging member surface can conveniently be erased by radiation illumination directed from the back side of the imaging member through the ACBC thickness of the imaging member during electrophotographic imaging processes.

In the extended embodiments of present disclosure, the film forming polymer used in plasticized CTL 20 may be a different one or the same A-B diblock copolymer utilized in the reformulated plasticized ACBC 1.

In conclusion, the present embodiments provide a plasticized ACBC reformulation, prepared according to the descriptions of the disclosure for application in a specific flexible imaging member which designed to contain a plasticized CTL. The disclosed plasticized ACBC reformulation has: enhanced physical and mechanical properties; scratch/wear resistance; good adhesion bonding to the support substrate; optical clarity/transparency to allow the convenient of imaging member belt back erase by radiant light; and very importantly, excellent curling control to render imaging member absolute flatness to meet high volume machines requirement.

In electrophotographic reproducing or digital printing apparatuses using a flexible imaging member belt prepared to comprise a plasticized CTL 20 and a plasticized ACBC 1 of present disclosure, a light image is recorded in the form of an electrostatic latent image upon a photosensitive member and the latent image is subsequently rendered visible by the application of a developer mixture. The developer, having toner particles contained therein, is brought into contact with the electrostatic latent image to develop the image on the imaging member belt which has a charge-retentive surface. The developed toner image can then be transferred to a copy out-put substrate, such as paper, that receives the image via a transfer member.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The development of the presently disclosed embodiments will further be demonstrated in the non-limited Working Examples below. They are, therefore in all respects, to be considered as illustrative and not restrictive nor limited to the materials, conditions, process parameters, and the like recited herein. The scope of embodiments are being indicated by the appended claims rather than the foregoing description. All changes that come within the meaning of and range of equivalency of the claims are intended to be embraced therein. All proportions are by weight unless otherwise indicated. It will be apparent, however, that the invention can be practiced with many types of compositions and can have many different uses in accordance with the disclosure above and as pointed out hereinafter.

Conventional Anti-Curl Back Coating Example

An anti-curl back coating (ACBC) was prepared by combining 88.2 grams of poly(4,4'-isopropylidene diphenyl carbonate) (i.e., bisphenol A polycarbonate) resin (FPC170 from Mitsubishi Chemicals), 7.12 grams VITEL PE-200 copolyester (available from Bostik, Inc. Middleton, Mass.) and 1,071 grams of methylene chloride in a carboy container to form a coating solution containing 8.2 percent solids. The container was covered tightly and placed on a roll mill for about 24 hours until the polycarbonate and polyester were dissolved in the methylene chloride to form the ACBC solution. The ACBC solution was then applied onto a 3.5 mils (89 micrometers) thickness biaxially oriented polyethylene naphthalate substrate (PEN, KADALEX, available from DuPont Teijin Films) by following the standard hand coating procedures and dried to a maximum temperature of 125° C. in the forced air oven for one minute to produce an optically clear 17 micrometers of dried ACBC thickness. The conventional ACBC as coated over the PEN substrate support, if unrestrained, curled spontaneously upward into a 1½ inch roll.

The bisphenol A polycarbonate used has a Tg of about 158° C., a weight average molecular weight (Mw) of 120,000 and a molecular formula shown below:

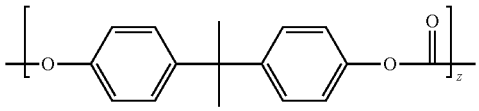

where z is about 470.

Disclosure Anticurl-Back Coating Example

Four disclosure ACBC reformulations (a, b, c, and d) were prepared in the exact same manners as those described in the Conventional Anti-Curl Back Coating Example described above, but with the exception that the bisphenol A polycarbonate was replaced with a high molecular weight film forming A-B diblock copolymer and also 8, 10, 12, and 14 weight percent of diethyl phthalate (DEP) plasticizer (based on the total weight each plasticized ACBC reformulations) were included into each of these ACBC formulations to effect Tg lowering result for respective curl control determination. The film forming A-B diblock copolymer used (available from Sabic Innovative Plastics) has molecular formulas shown in the following:

Formula 1

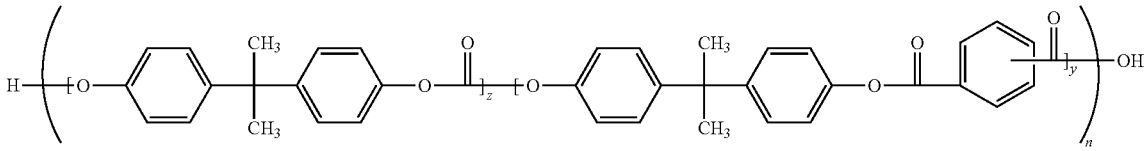

Formula 2

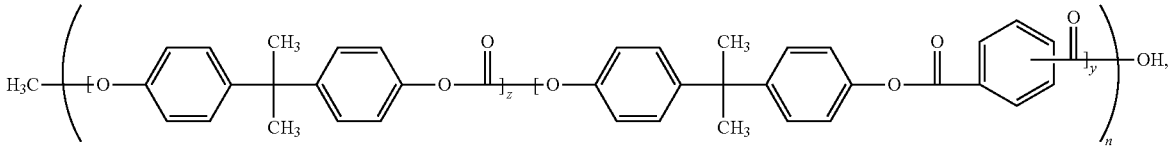

In this very specific disclosure example embodiment, the diblock copolymer (obtained from Sabic Innovative Plastics) for plasticized ACBC reformulation has a weight average molecular weight of 175,000, the degree of polymerization n of about 60, the number of bisphenol A polycarbonate units z in Block (A) of 9, and the number of phthalic acid unit in block (B) of 1. The Tg of this A-B diblock copolymer is about 168° C.

The plasticizer DEP (available from Sigma-Aldrich Company) selected for use has a boiling point of about 295° C. and a molecular formula shown below:

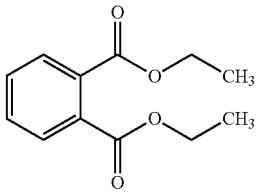

In assessing the degree of curl exhibition, the four resulting plasticized ACBC of the Disclosure Example and along the Conventional ACBC, obtained after drying and cooling to room ambient, were found to be adhesion bonded strongly to PEN substrate and all gave a 180° peel-strength exceeding 95 grams/cm. Very importantly, all these ACBC had excellent optical clarity and also exhibit notable reduction in upward curling with respect to the increase in amount of DEP addition into each ACBC reformulation. The results obtained from curl measurement are listed in Table 1 below:

TABLE 1

| ACBC Example | Diethyl Phthalate Content (% wt) | Diameter of Curvature |
|---|---|---|
| Conventional | 0 | 1.5 inches |
| Disclosure a | 8 | 12.4 inches |
| Disclosure b | 10 | 15.1 inches |
| Disclosure c | 12 | Nearly Flat |
| Disclosure d | 14 | Total Flatness |

Note:
The 8, 10, 12, and 14 weight percent DEP plasticized ACBC as prepared has a Tg of 152-° C., 148° C., 143° C., and 138° C., respectively.

Conventional Imaging Member Preparation Example

A conventional negatively charged flexible electrophotographic imaging member web was prepared by providing a 0.02 micrometer thick titanium layer coated substrate of a biaxially oriented polyethylene naphthalate substrate (PEN, available as KADALEX from DuPont Teijin Films) having a thickness of 3½ mils (89 micrometers), and extrusion coating the titanized KADALEX substrate with a blocking layer solution containing a mixture of 6.5 grams of gamma aminopropyltriethoxy silane, 39.4 grams of distilled water, 2.1 grams of acetic acid, 752.2 grams of 200 proof denatured alcohol and 200 grams of heptane. The resulting wet coating layer was allowed to dry for 5 minutes at 135° C. in a forced air oven to remove the solvents from the coating and effect the formation of a crosslinked silane blocking layer. The resulting blocking layer had an average dry thickness of 0.04 micrometer as measured with an ellipsometer.

An adhesive interface layer was then applied by extrusion coating to the blocking layer with a coating solution containing 0.16 percent by weight of ARDEL polyarylate, having a weight average molecular weight of about 54,000, available from Toyota Hsushu, Inc., based on the total weight of the solution in an 8:1:1 weight ratio of tetrahydrofuran/monochloro-benzene/methylene chloride solvent mixture. The adhesive interface layer was allowed to dry for 1 minute at 125° C. in a forced air oven. The resulting adhesive interface layer had a dry thickness of about 0.02 micrometer.

The adhesive interface layer was thereafter coated over with a charge generating layer. The charge generating layer (CGL) dispersion was prepared as described below:

To a 4 ounce glass bottle was added IUPILON 200, a polycarbonate of poly(4,4'-diphenyl)-1,1'-cyclohexane carbonate (PC-z 200, available from Mitsubishi Gas Chemical Corporation) (0.45 grams), and tetrahydrofuran (50 milliliters), followed by hydroxygallium phthalocyanine Type V (2.4 grams) and ⅛ inch (3.2 millimeters) diameter stainless steel shot (300 grams). The resulting mixture was placed on a ball mill for about 20 to about 24 hours to obtain a slurry. Subsequently, a solution of poly(4,4'-diphenyl-1,1'-cyclohexane carbonate) (2.25 grams) having a weight average molecular weight of 20,000 (PC-z 200) dissolved in tetrahydrofuran (46.1 grams) was added to the hydroxygallium phthalocyanine slurry. The resulting slurry was placed on a shaker for 10 minutes and thereafter coated onto the adhesive interface by extrusion application process to form a layer having a wet thickness of 0.25 mil. A strip of about 10 millimeters wide along one edge of the substrate web stock bearing the blocking layer and the adhesive layer was deliberately left uncoated by the charge generating layer to facilitate adequate electrical contact by a ground strip layer to be applied later. The resulting CGL containing poly(4,4'-diphenyl)-1,1'-cyclohexane carbonate, tetrahydrofuran and hydroxygallium phthalocyanine was dried at 125° C. for 2 minutes in a forced air oven to form a dry charge generating layer having a thickness of 0.4 micrometers.

This coated web stock was simultaneously coated over with a charge transport layer (CTL) and a ground strip layer by co-extrusion of the coating materials. The CTL was prepared as described below:

To an amber glass bottle was added bisphenol A polycarbonate thermoplastic having an average molecular weight of about 120,000 (FPC 0170, commercially available from Mitsubishi Chemicals) and a charge transport compound of N,N'-diphenyl-N,N'-bis(3-methylphenyl)-1,1'-biphenyl-4,4'-diamine. The weight ratio of the bisphenol A polycarbonate thermoplastic and N,N'-diphenyl-N,N'-bis(3-methylphenyl)-1,1'-biphenyl-4,4'-diamine was 1:1. The resulting mixture was dissolved in methylene chloride such that the solid weight percent in methylene chloride was 15 percent by weight. Such mixture was applied on the CGL by extrusion to form a coating which upon drying in a forced air oven gave a dry CTL of 29 micrometers thick. The Tg of the CTL comprising 1:1 weight ratio of bisphenol A polycarbonate thermoplastic and N,N'-diphenyl-N,N'-bis(3-methylphenyl)-1,1'-biphenyl-4,4'-diamine is about 85° C.

The strip, about 10 millimeters wide, of the adhesive layer left uncoated by the charge generator layer, was coated with a ground strip layer during the co-extrusion process. The ground strip layer coating mixture was prepared as described below:

To a carboy container was added 23.8 grams of bisphenol A polycarbonate resin (FPC 0170) and 332 grams methylene chloride. and methylene chloride (332 grams). The container was covered tightly and placed on a roll mill for about 24 hours until the polycarbonate was dissolved and gave a 7.9 percent by weight solution. The prepared solution was mixed for 15-30 minutes with about 94 grams of graphite dispersion solution (available as RW22790, from Acheson Colloids Company) to give ground strip layer coating solution. (Note: The graphite dispersion solution, RW22790 as commercially obtained, contained a 12.3 percent by weight solids including 9.41 parts by weight of graphite, 2.87 parts by weight of ethyl cellulose, and 87.7 parts by weight of solvent).

To effect homogeneous graphite dispersion, the resulting ground strip layer coating solution was then mixed with the aid of a high shear blade dispersed in a water cooled, jacketed container to prevent the dispersion from overheating and losing solvent. The resulting dispersion was then filtered and the viscosity was adjusted with the aid of methylene chloride. This ground strip layer coating mixture was then applied, by co-extrusion with the CTL, to the electrophotographic imaging member web to form an electrically conductive ground strip layer having a dried thickness of about 19 micrometers.

The imaging member web stock containing all of the above layers was then passed through 125° C. in a forced air oven for 3 minutes to simultaneously dry both the CTL and the ground strip. Since the CTL has a Young's Modulus of $3.5\times10^5$ psi ($2.4\times10^4$ Kg/cm$^2$) and a thermal contraction coefficient of $6.5\times10^{-5}$/° C. compared to the Young's Modulus of $5.5\times10^5$ psi ($3.8\times10^4$ Kg/cm$^2$) and thermal contraction coefficient of $1.8\times10^{-5}$/° C. for the PEN substrate support, the CTL was about 3.6 times greater in dimensional shrinkage than that of PEN substrate support. Therefore, the imaging member web if unrestrained at this point would curl upwardly into a 1½-inch tube.

To effect imaging member curl control, a conventional ACBC was prepared by combining 88.2 grams of FPC 0170 bisphenol A polycarbonate resin, 7.12 grams VITEL PE-2200 copolyester (available from Bostik, Inc. Middleton, Mass.), and 1,071 grams of methylene chloride in a carboy container to form a coating solution containing 8.2 percent solids. The container was covered tightly and placed on a roll mill for about 24 hours until the polycarbonate and polyester were dissolved in methylene chloride to form an anti-curl back coating solution. The ACBC solution was applied to the rear surface (side opposite to the charge generating layer and CTL) of the electrophotographic imaging member web by extrusion coating and dried to a maximum temperature of 125° C. in a forced air oven for about 3 minutes to produce a dried ACBC having a thickness of 17 micrometers and flattening the imaging member.

Control Imaging Member Preparation Example

A control negatively charged flexible electrophotographic imaging member web was prepared by using the exact same materials, composition, and following identical procedures as described in the preceding Conventional Imaging Member Preparation Example, except that ACBC was intentionally omitted and both the CTL and the ground strip layer were both plasticized by incorporation of 8 weight percent DEP in each respective layer matrix. The resulting ACBC-free imaging member, as obtained to contain the plasticized CTL/ground strip layer (cut to give a 2 inch by 15 inch sample cut piece), if unrestrained and left free standing on a table, was seen exhibit a nearly flat configuration of about 14.8 inches of diameter of curvature, and is to be used to serve as a Control.

Nearly flat imaging member configuration refers in particular to an ACBC-free flexible negatively charge imaging member prepared to have the CTL incorporated with a plasticizer in its material matrix to effect reduction of internal stress/strain build-up in the layer to minimize/suppress the extent of imaging member curling-up. That means plasticizing the CTL by 8 weight percent DEP incorporation could only impact partial decease in the thermal dimensional contraction differential between the CTL and PEN substrate, so the prepared imaging member did not have a total flatness configuration but still showed a mild degree of upward curling equals to or greater than 14 inches in diameter of curvature.

Although imaging member flatness had been experimentally demonstrated by increasing the DEP incorporation level to beyond 12 weight percent. Nonetheless, this high DEP loading level was found to significantly drop the glass transition temperature, $Tg_{CTL}$, of the plasticized CTL to about 45° C., a temperature too low unpractical for application as it is way below the typical machine cavity operation temperature of 50° C. in the field.

A conventional CTL is a solid solution layer, consisting of 1:1 weight ratio of a bisphenol A polycarbonate and a charge transport compound of N,N'-diphenyl-N,N'-bis(3-methylphenyl)-1,1'-biphenyl-4,4'-diamine, had a $Tg_{CTL}$ of 85° C. However, incorporation of 8 weight percent DEP into the CTL was seen to depress its Tg down to 58° C., an acceptable and functional temperature for imaging member production implementation because it is still above the typical 50° C. machine cavity operation temperature in the field.

Disclosure Imaging Member Preparation Example I

Even though the above ACBC-free Imaging Member Control prepared to contain 8 weight percent plasticized CTL/ground strip was able to give a nearly flat configuration, plus the benefits of excellent photo-electrical cyclic stability, and copy print out quality improvement result in actual machine belt print test run, but it is still yet not meet the stringent high volume machines imaging member belt flatness requirement. Moreover, since the bottom PEN substrate (without the protection of an ACBC) was exposed to numbers of belt module support rollers and backer bars mechanical friction interactions under a normal imaging member belt function in the high volume machine, pre-mature onset of PEN substrate wear/scratch failure had became a serious problem to limit the ACBC-free imaging member application value.

To resolve these short comings while preserving/maintaining the photo-electrical stability and copy print quality improvement benefits, the very same negatively charged flexible ACBC-free electrophotographic imaging member web (prepared to have both the CTL and the ground strip layer plasticized by 8 weight percent DEP addition in each respective layer matrix) of the Control Imaging Member Preparation Example described in the preceding was then modified/improved to include a plasticized ACBC of this disclosure by using the high molecular weight film forming A-B diblock copolymer.

The plasticized ACBC, added onto and cover PEN support substrate to provide substrate wear protection and effect imaging member curl control, was a reformulation prepared to comprise A-B diblock copolymer, VITEL PE-200 copolyester adhesion promoter, and incorporation of DEP. The resulting plasticized ACBC (having a thickness of 17 micrometers and comprised of 81 weight percent copolymer, 7 weight percent adhesion promoter, and 12 weight percent DEP, based on the total weight of the ACBC) was seen to give the resulting imaging member a curl-free and flat configuration.

In addition, since the plasticized ACBC reformulated according to this disclosure had excellent optical transmittance, so this allow the residual voltage remaining after completion of a photoelectrical imaging process on the imaging member surface to be conveniently erased by radiation illumination directed from the back side of the imaging member belt through the ACBC thickness of the imaging member during electrophotographic imaging processes.

In relative comparison:

(1) The Young's Modulus of the plasticized CTL of this disclosure was about $3.5\times10^5$ psi ($2.4\times10^4$ Kg/cm$^2$) and a thermal contraction coefficient of about $6.5\times10^{-5}$/° C.;

(2) The Young's Modulus of the plasticized ACBC was about $3.2\times10^5$ psi ($2.2\times10^4$ Kg/cm$^2$) and a thermal contraction coefficient of between about $6.7\times10^{-5}$/° C.; And (3) The Young's Modulus of the PEN substrate support was about $5.5\times10^5$ psi ($3.8\times10^4$ Kg/cm$^2$) and a thermal contraction coefficient of $1.8\times10^{-5}$/° C.

Disclosure Imaging Member Preparation Example II

An additional flexible imaging member web was prepared following the same procedures and using identical materials to form all the layers as those described in the preceding Disclosure imaging Member Preparation Example I, except that the 12 weight percent DEP loaded plasticized ACBC was further modified to include 5 weight percent polyterafluoroethylene (PTFE) dispersion (particle size of 0.2 micrometer available as ZONYL MP1000 from E.I. du Pont de Nemours & company) in its layer matrix, based on the resulting weight of the disclosed ACBC, to impact wear resistance enhancement.

The plasticized ACBC, as modified to contain the PTFE particle dispersion in its material matrix, did also have good optical clarity and likewise gave the resulting imaging member excellent curl control to render flatness.

Adhesion and Wear Assessments

The imagine member webs of Disclosure Example I (having plasticized ACBC) and Disclosure Example II (having PTFE dispersion in the plasticized ACBC), prepared according to the preceding Working Example Disclosure, were determined for each respective plasticized ACBC adhesion bond strength to the PEN substrate and then evaluated further for the mechanical friction wear resistance along with the ACBC-free imaging member web (having bottom exposed PEN substrate) prepared from the Control Imaging Member Preparation described above.

The plasticized ACBC adhesion bond strength to the substrate support of the imaging members was carried out by 180° peel strength measurement. Peel measurement test samples were prepared by cutting a minimum of three 0.5 inch (1.2 cm)×6 inches (15.24 cm) imaging member strips from each imaging member web of the two Disclosure Working Examples. For each test sample strip, the plasticized ACBC was partially separated off from one end of the test strip (with the aid of a razor blade) and then hand peeled to give about 3.5 inches from that end to expose the substrate support layer the sample strip. This test sample strip was then secured to a 1 inch (2.54 cm)×6 inches (15.24 cm) and 0.05 inch (0.254 cm) thick aluminum backing plate (having the CTL facing and adhering to the backing plate) with the aid of two sided adhesive tape. The end of the resulting assembly, having the peeled off plasticized ACBC, was inserted into the upper jaw of an Instron Tensile Tester. The free end of the partially peeled plasticized ACBC was inserted into the lower jaw of the Instron Tensile Tester. The jaws were then activated at a one inch/mm. crosshead speed, a two inch chart speed and a load range of 200 grams, to peel the sample at least two inches at an angle of 180°. The load was calculated to derive the peel strength of the plasticized ACBC adhesion to the substrate. The peel strength was determined to be the load required for peeling off the plasticized ACBC divided by the width (1.27 cm) of the test sample strip.

For wear resistance assessment, the imaging member webs of the two Disclosure Examples and the plasticized ACBC-free imaging member (having exposed bottom PEN substrate) were each again cut to give a size of 1 inch (2.54 cm) by 12 inches (30.48 cm) sample and then assed for its respective resistance to wear. Testing was conducted by means of a dynamic mechanical cycling device in which glass tubes were skidded across and on the test surface on each sample. More specifically, one end of the test sample was clamped to a stationary post and the sample was looped upwardly over three equally spaced horizontal glass tubes and then downwardly over a stationary guide tube through a generally inverted "U" shaped path with the free end of the sample secured to a weight which provided one pound per inch width tension on the sample. The surface of the test sample bearing the plasticized ACBC or the exposed PEN substrate was faced downwardly so that it would periodically be brought into sliding mechanical contact with the glass tubes. The glass tubes had a diameter of one inch.

Each tube was secured at each end to an adjacent vertical surface of a pair of disks that were rotatable about a shaft connecting the centers of the disks. The glass tubes were parallel to and equidistant from each other and equidistant from the shaft connecting the centers of the disks. Although the disks were rotated about the shaft, each glass tube was rigidly secured to the disk to prevent rotation of the tubes around each individual tube axis. Thus, as the disk rotated about the shaft, two glass tubes were maintained at all times in sliding contact with the surface of the plasticized ACBC or the exposed PEN substrate. The axis of each glass tube was positioned about 4 cm from the shaft. The direction of movement of the glass tubes along the charge transport layer surface was away from the weighted end of the sample toward the end clamped to the stationary post. Since there were three glass tubes in the test device, each complete rotation of the disk was equivalent to three wear cycles in which the surface of the test sample was in sliding mechanical contact with a single stationary support tube during the testing. The rotation of the spinning disk was adjusted to provide the equivalent of 11.3 inches (28.7 cm) per second tangential speed. The extent of plasticized ACBC or the exposed PEN substrate wear-off by the sliding contact friction against the glass tubes was measured using a permascope at the end of a 330,000 wear cycles test.

The results obtained for plasticized ACBC 180° peel-off strength and wear resistance are listed in Table 2 below:

TABLE 2

| Imaging Member | PTFE in ACBC | Thickness Peel Strength (gms/cm) | Wear Off (microns) |
|---|---|---|---|
| Control | None (Substrate Exposed) | Not Applicable | 18.4 |
| Disclosure Example I | None | 98 | 10.1 |
| Disclosure Example II | 5% wt | 93 | 1.3 |

Table 2 showed that the electrophotographic imaging member containing a plasticized ACBC reformulated to comprise A-B diblock copolymer, PE 200 adhesion promoter, and DEP plasticizer gave strong adhesion bond strength to the PEN substrate. Importantly, wear resistance of the two plasticized ACBC of Disclosure Example I and II were seen to be much more superior compared to the exposed PEN substrate of the ACBC-free imaging member; and additionally, inclusion of 5 weight percent PTFE particles dispersion did provide significant wear resistance enhancement over that of the plasticized ACBC counterpart. In essence the plasticized ACBC reformulation prepared according to the description detailed in all the preceding embodiments disclosure had excellent adhesion bonding strength to the PEN substrate and good wear resistance, and of equal important is that such ACBC should have optically suitable transmittance (e.g., transparency), so that the residual voltage remaining after completion of a photoelectrical imaging process on the imaging member surface can conveniently be erased by radiation illumination from the back side through the ACBC thickness of the imaging member during electrophotographic imaging processes.

Therefore, the experimental results obtained and demonstrated in all the above embodiments had indicated that flexible imaging member belt prepared to employ a plasticized CTL for curl suppression did indeed require the inclusion of a plasticized ACBC reformulation of the present disclosure to provide: (a) protection of the substrate support against premature onset of back side of the belt wear failure under dynamic machine imaging member belt cycling condition in the field, (b) preservation/maintain the photo-electrical stability and copy print quality improvement benefits offered by a plasticized CTL, and (c) imaging member flatness to meet stringent machine belt flatness requirement.

All the patents and applications referred to herein are hereby specifically, and totally incorporated herein by reference in their entirety in the instant specification.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

All the patents and applications referred to herein are hereby specifically, and totally incorporated herein by reference in their entirety in the instant specification.

What is claimed is:

1. A flexible imaging member comprising:

a flexible electrically conductive substrate;

a charge generation layer disposed on the substrate;

at least one plasticized charge transport layer disposed on the charge generating layer; and a plasticized anti-curl back coating layer disposed on a side of the substrate opposite the charge generation layer and the plasticized charge transport layer, wherein the plasticized charge transport layer comprises a film forming polymer binder, a charge transport compound, and a plasticizer, and the plasticized anti-curl back coating layer comprises a liquid plasticizer and a high molecular weight film forming A-B diblock copolymer polycarbonate having a formula of:

Formula I $$R_1-(-[\text{Block A}]_z-[\text{Block B}]_y-)_n-OH$$

wherein Block A is a polycarbonate, Block B comprises an organic acid, z is from about 9 to about 45, y is from about 1 to about 6, n is between about 20 and about 80, and $R_1$ is H or $CH_3$, and the anti-curl back coating layer further comprises a liquid plasticizer.

2. The flexible imaging member of claim 1, wherein the anti-curl back coating layer further comprises an adhesion promoter and an organic or inorganic particle dispersion.

3. The flexible imaging member of claim 1, wherein the A-B diblock copolymer polycarbonate contains about 90 mole percent of Block A repeating units linearly linking to about 10 mole percent of Block B repeating units and further wherein Block B contains a dicarboxylic acid terminal group in the A-B diblock copolymer chain.

4. The flexible imaging member of claim 3, wherein Block A is a phenol-carbonate selected from the group consisting of:

Formula A-1

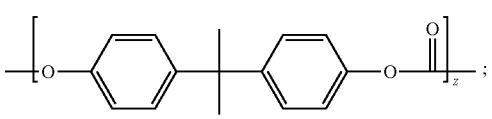

Formula A-2

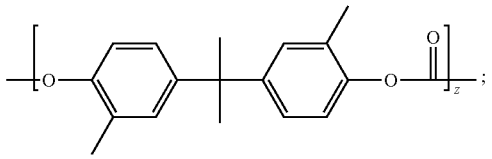

-continued

Formula A-3

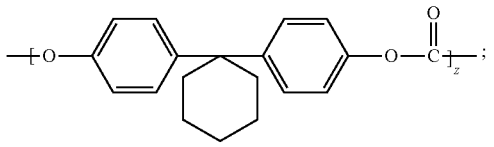

Formula A-4

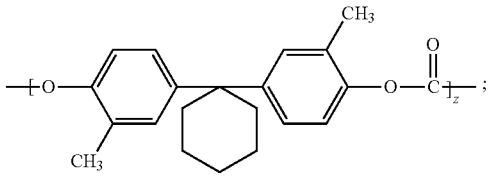

Formula A-5

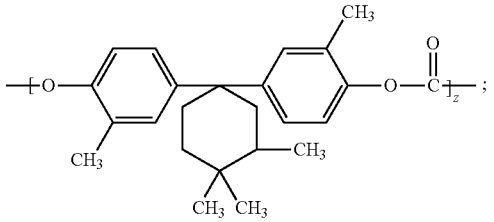

Formula A-6

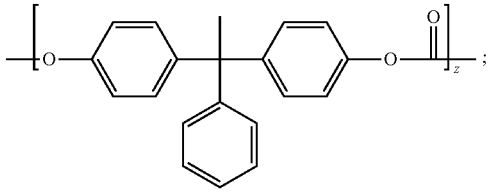

and mixtures thereof, wherein z is from about 9 to about 45 to about 54.

5. The flexible imaging member of claim 3, wherein the dicarboxylic acid terminal group is selected from the group consisting of:

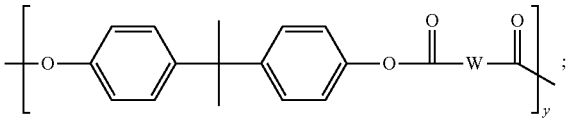

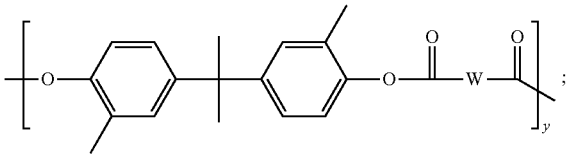

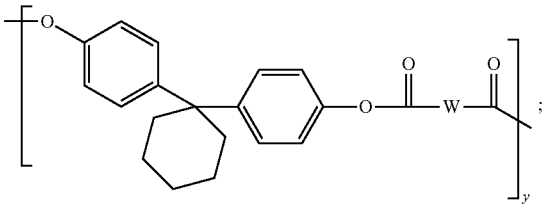

-continued

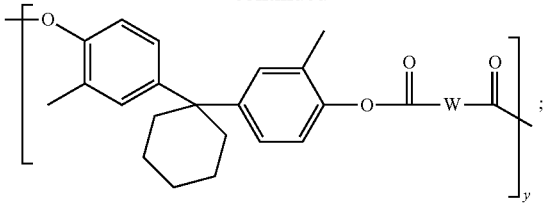

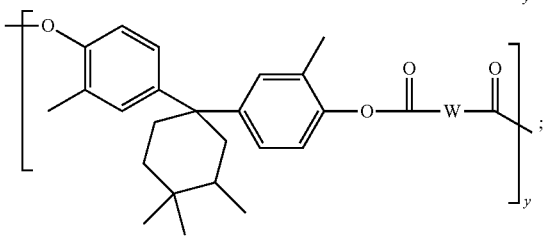

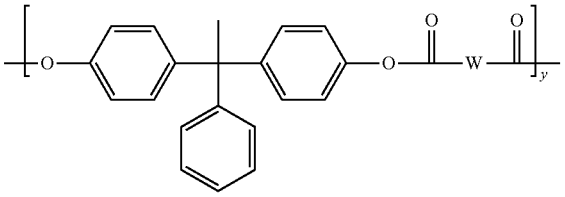

and mixtures thereof, wherein W is an aromatic moiety or an aliphatic moiety, and y is from about 1 to about 6.

6. The flexible imaging member of claim 1, wherein the A-B diblock copolymer has a weight average molecular weight of between about 80,000 and about 250,000.

7. The flexible imaging member of claim 1, wherein the A-B diblock copolymer is selected from the group consisting of Formula (I) and Formula (II) below:

Formula 1

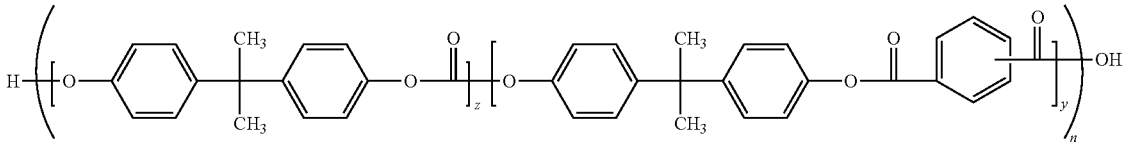

Block (A) Block (B)

Formula 2

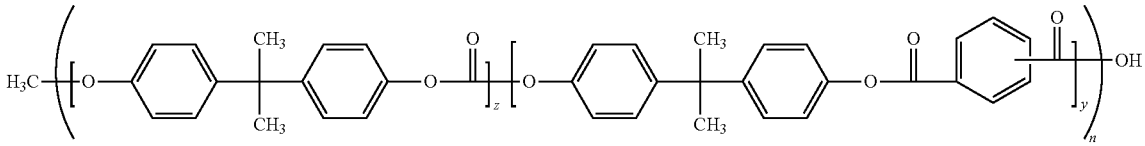

Block (A) Block (B)

wherein z represents the number of bisphenol A repeating units in Block A of from about 9 to about 54, y is number of repeating phthalic acid Block B of from about 1 to about 6, and n is the degree of polymerization between about 20 and about 80 for the copolymer having a weight average molecular weight between about 80,000 and about 250,000.

8. The flexible imaging member of claim 1, wherein the liquid plasticizer is selected from the group consisting of a phthalate, a phthalate derivative, a diallyl terephthalate, a modified diallyl terephthalate, a diallyl isophthalate, a modified diallyl isophthalate, a liquid carbonate, a styrene derivative, a dibasic alkyl ester, and a fluoroketone.

9. The flexible imaging member of claim 8, wherein the phthalate is selected from the group consisting of:

Formula (I)

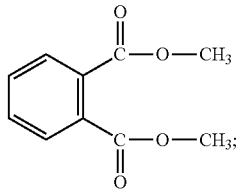

Formula (IA)

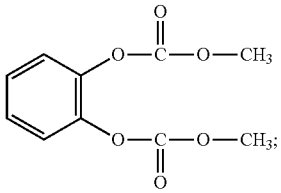

Formula (II)

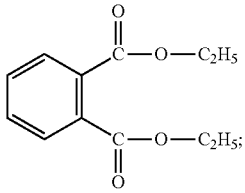

-continued

Formula (IIA)

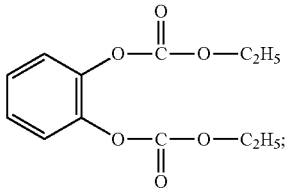

-continued
Formula (III)
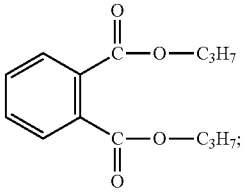
Formula (IV)
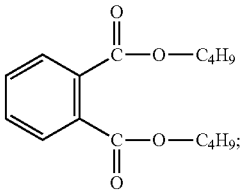
Formula (V)
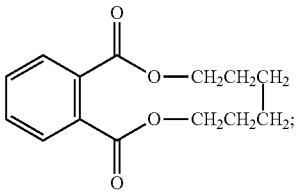
-continued
Formula (VI)
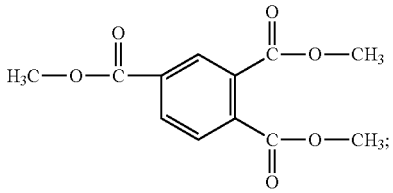
Formula (VII)
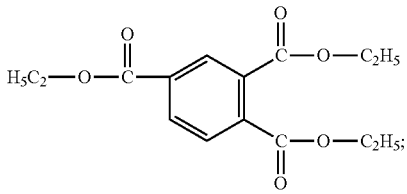
and mixtures thereof.
10. The flexible imaging member of claim 8, wherein the liquid carbonate is selected from the group consisting of:
Formula (1)
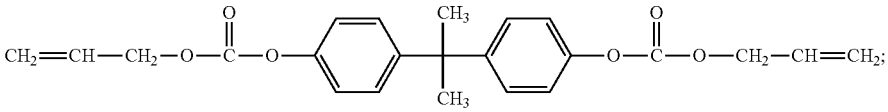
Formula (2)
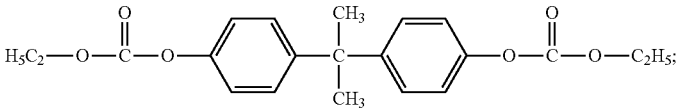
Formula (3)
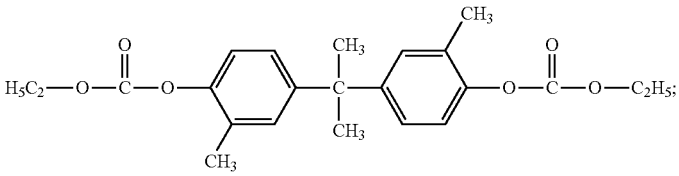
Formula (4)
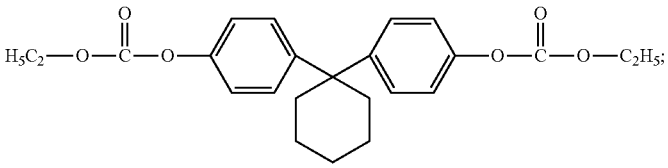
Formula (5)
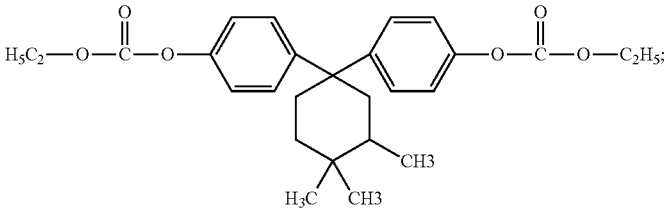

-continued

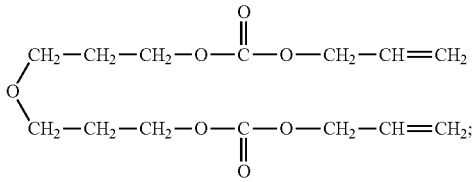

and mixtures thereof.

11. The flexible imaging member of claim 8, wherein the styrene derivative is selected from the group consisting of:

Formula (B)

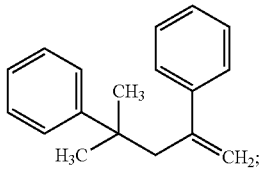

Formula (A)

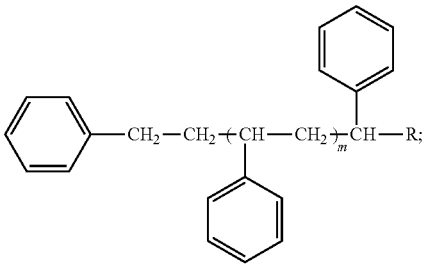

and mixtures thereof, wherein R is selected from the group consisting of H, $CH_3$, $CH_2CH_3$, and $CH{=}CH_2$, and m is between 0 and 3.

12. The flexible imaging member of claim 8, wherein the fluoroketone is selected from the group consisting of:

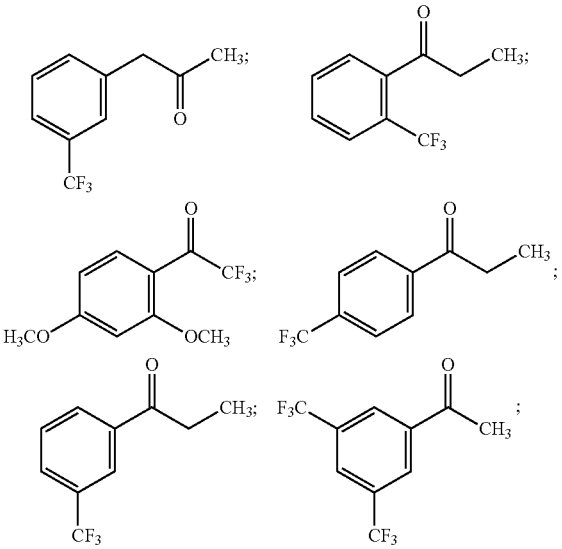

Formula (6)

-continued

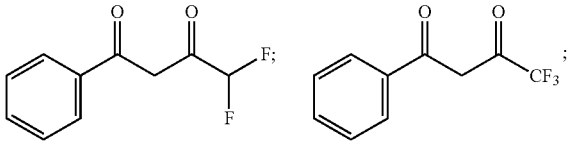

and mixtures thereof.

13. The flexible imaging member of claim 1, wherein the liquid plasticizer has a boiling point of at least 250° C.

14. The flexible imaging member of claim 1, wherein the film forming polymer binder used in the plasticized charge transport layer is selected from the group consisting of a bisphenol A polycarbonate, poly(4,4'-isopropylidene diphenyl carbonate), having a weight average molecular weight of from about 80,000 to about 250,000, and a molecular structure of Formula X below:

Formula X

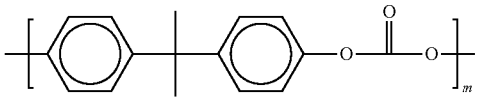

wherein m is from about 310 to about 990; a bisphenol Z polycarbonate, poly(4,4'-diphenyl-1,1'-cyclohexane carbonate), having a weight average molecular weight of from about 80,000 to about 250,000, and a molecular structure of Formula Y below:

Formula Y

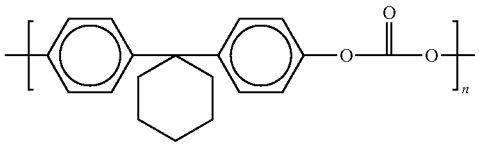

wherein n is from about 270 to about 850; and mixtures thereof.

15. The flexible imaging member of claim 1, wherein the film forming polymer binder used in the plasticized charge transport layer is a A-B diblock copolymer having a weight average molecular weight between about 80,000 and about 250,000 selected from the group consisting of Formula (I) and Formula (II) below:

Formula 1

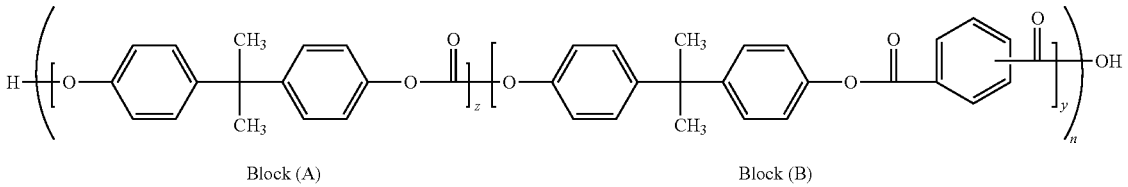

Formula 2

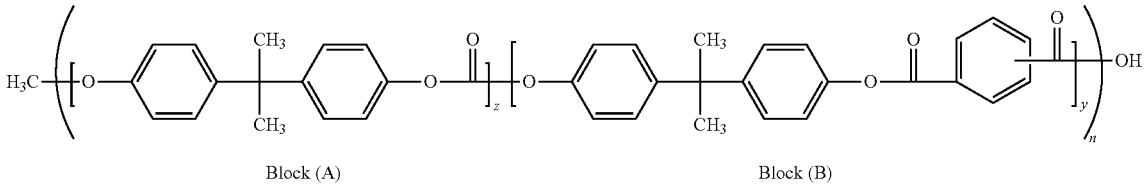

wherein z is from about 9 to about 54, y is from about 1 to about 6, and n is between about 20 and about 80.

16. The flexible imaging member of claim 1, wherein the plasticizer selected for use in the plasticized charge transport layer is different or the same as one used in the plasticized anti-curl back coating layer.

17. A flexible imaging member comprising:

a flexible electrically conductive substrate;

a charge generation layer disposed on the substrate;

at least one plasticized charge transport layer disposed on the charge generating layer; and a plasticized anti-curl back coating layer disposed on a side of the substrate opposite the charge generation layer and the plasticized charge transport layer, wherein the plasticized charge transport layer comprises a film forming polymer binder, a charge transport compound, and a plasticizer, and the plasticized anti-curl back coating layer comprises an adhesion promoter, a liquid plasticizer, an organic or inorganic particles dispersion in the anti-curl back coating layer and a high molecular weight film forming A-B diblock copolymer polycarbonate having a formula of:

Formula I

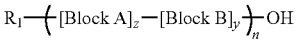

wherein Block A is a polycarbonate, block B comprises an organic acid, z is from about 9 to about 54, y is from about 1 to about 6, n is between about 20 and about 80, and $R_1$ is H or $CH_3$.

18. The flexible imaging member of claim 17, wherein the A-B diblock copolymer contains about 90 mole percent of Block A repeating units linearly linking to about 10 mole percent of Block B repeating units and further wherein Block B has a dicarboxylic acid terminal group in the A-B diblock copolymer chain.

19. The flexible imaging member of claim 18, wherein Block A is a phenol-carbonate selected from the group consisting of:

Formula A-1

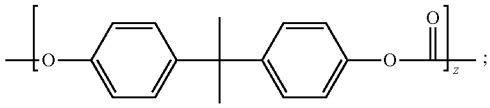

Formula A-2

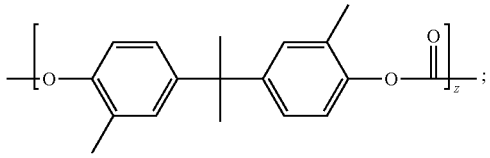

Formula A-3

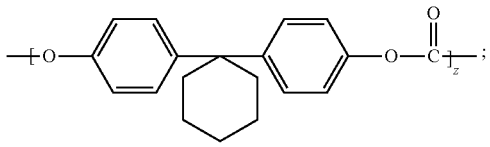

Formula A-4

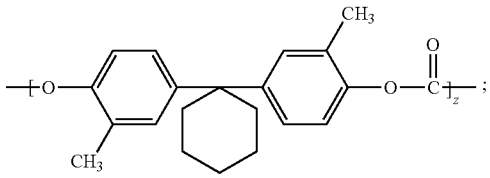

Formula A-5

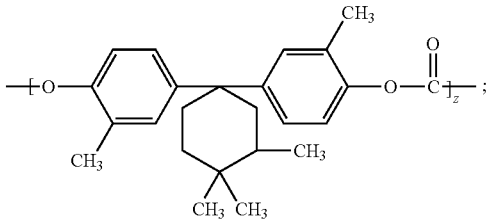

-continued

Formula A-6

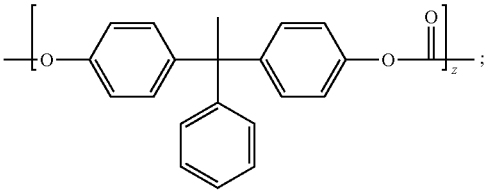

and mixtures thereof, wherein z is from about 9 to about 54.

20. The flexible imaging member of claim 18, wherein the dicarboxylic acid terminal group is selected from the group consisting of:

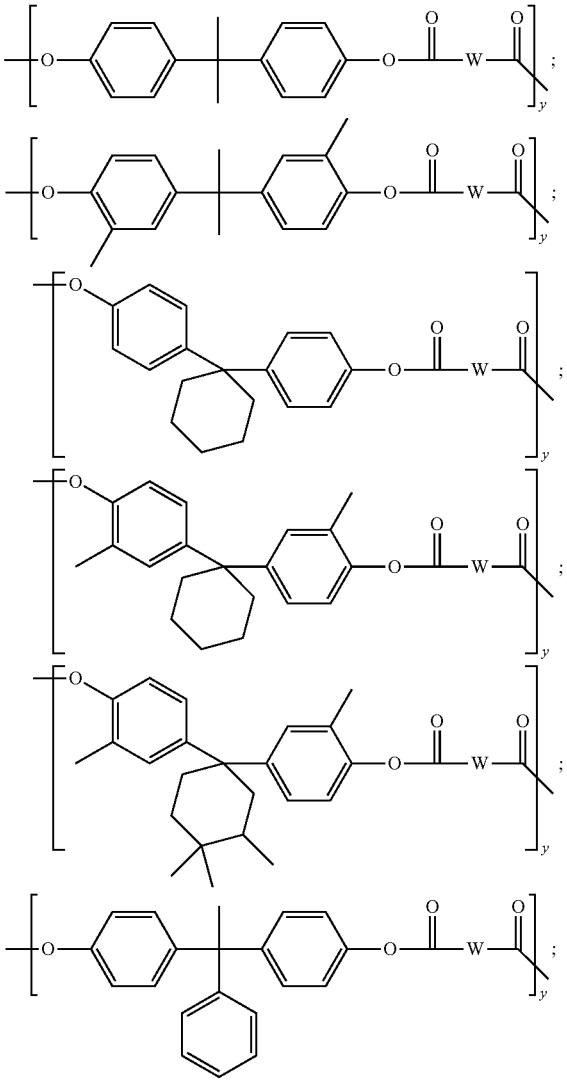

and mixtures thereof, wherein W is an aromatic moiety or an aliphatic moiety, and y is from about 1 to about 6.

21. A flexible imaging member comprising:

a flexible electrically conductive substrate;

a charge generation layer disposed on the substrate;

at least one plasticized charge transport layer disposed on the charge generating layer;

an overcoat layer disposed on the plasticized charge transport layer;

a plasticized anti-curl back coating layer disposed on a side of the substrate opposite the charge generation layer and charge transport layer; and a plasticized ground strip layer disposed over one edge and adjacent to the plasticized charge transport layer of the flexible imaging member, wherein the plasticized charge transport layer, overcoat layer, plasticized anti-curl back coating layer and plasticized ground strip layer comprises a high molecular weight film forming A-B diblock copolymer polycarbonate having a formula of:

Formula I

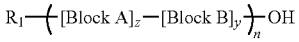

wherein Block A is a polycarbonate, Block B comprises an organic acid z is from about 9 to about 54, y is from about 1 to about 6, n is between about 20 and about 80, and $R_1$ is H or $CH_3$, and the plasticized anti-curl back coating layer further comprises an adhesion promoter and an organic or inorganic particle dispersion in the anti-curl back coating layer.

22. The flexible imaging member of claim 21, wherein the A-B diblock copolymer contains about 90 mole percent of Block A repeating units linearly linking to about 10 mole percent of Block B repeating units and further wherein Block B has a dicarboxylic acid terminal group in the A-B diblock copolymer chain.

23. The flexible imaging member of claim 21, Block A is a phenol-carbonate selected from the group consisting of:

Formula A-1

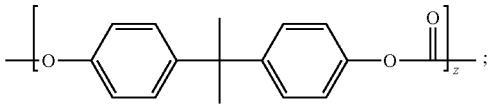

Formula A-2

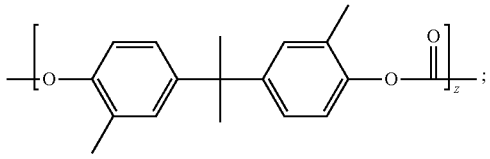

Formula A-3

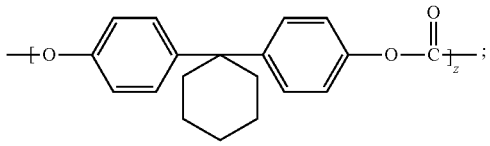

Formula A-4

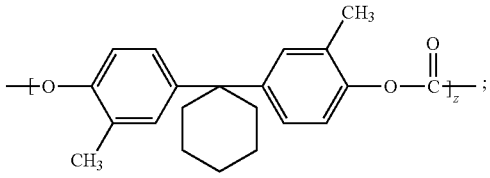

-continued

Formula A-5

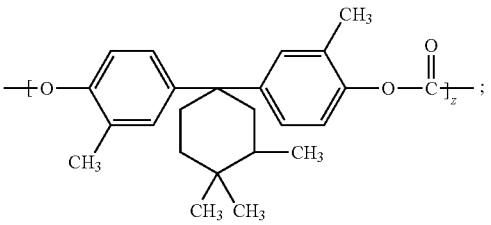

Formula A-6

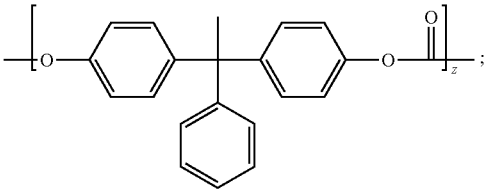

and mixtures thereof, wherein z is from about 9 to about 54, and the dicarboxylic acid terminal group is selected from the group consisting of:

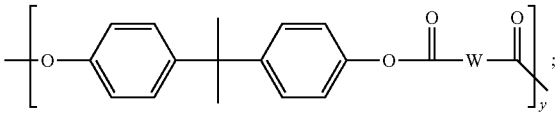

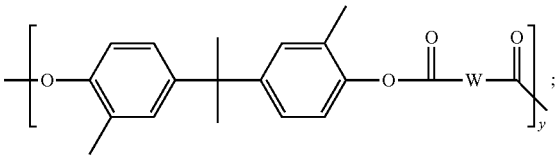

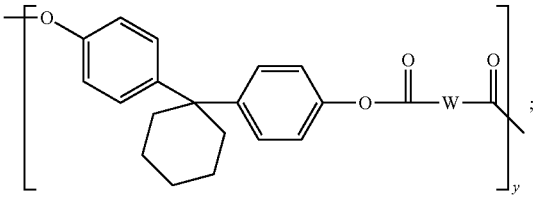

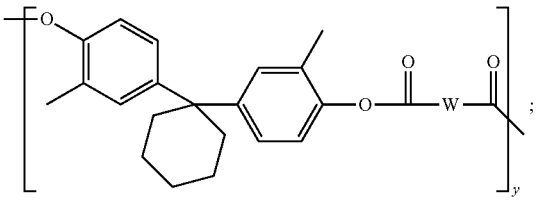

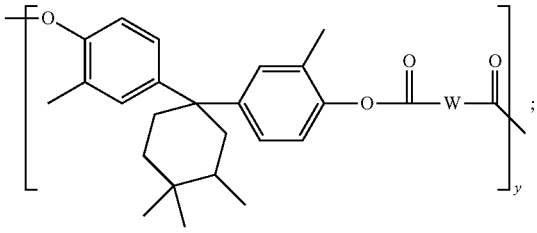

-continued

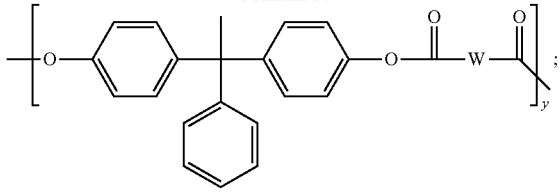

and mixtures thereof, wherein W is an aromatic moiety or an aliphatic moiety, and y is from about 1 to about 6.

24. The flexible imaging member of claim 21, wherein the liquid plasticizer in the plasticized anti-curl back coating layer is a phthalate liquid selected from the group consisting of:

Formula (I)

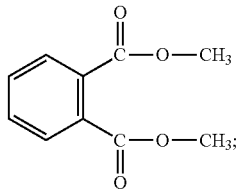

Formula (IA)

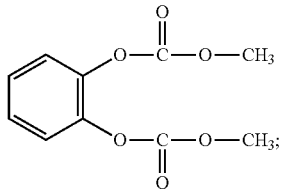

Formula (II)

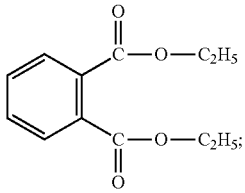

Formula (IIA)

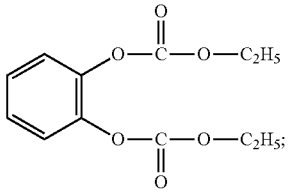

Formula (III)

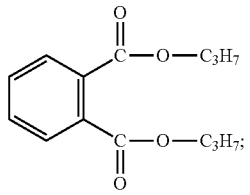

Formula (IV)

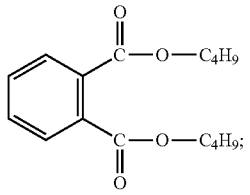

-continued
Formula (V)
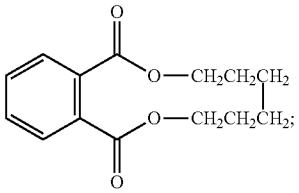
Formula (VI)
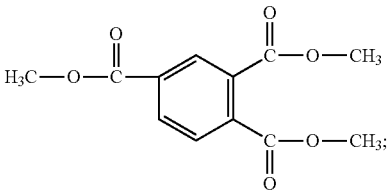
-continued
Formula (VII)
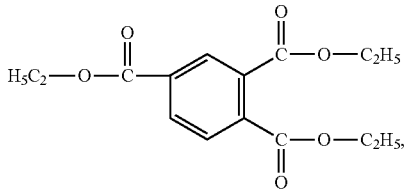
and mixtures thereof, or a carbonate liquid selected from the group consisting of:
Formula (1)
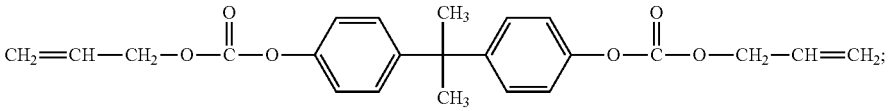
Formula (2)
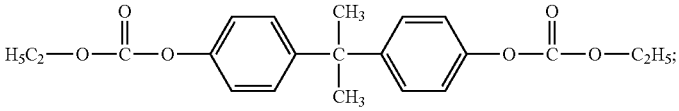
Formula (3)
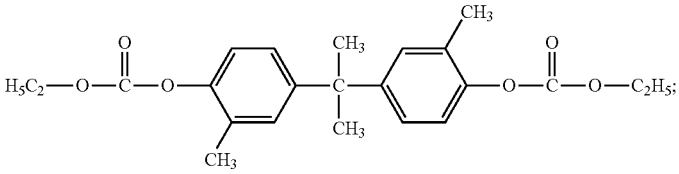
Formula (4)
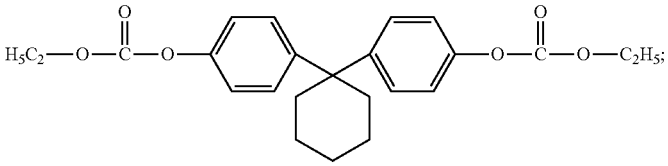
Formula (5)
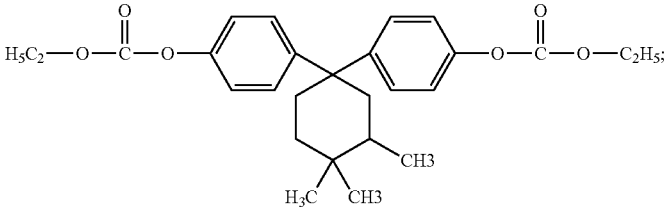
Formula (6)
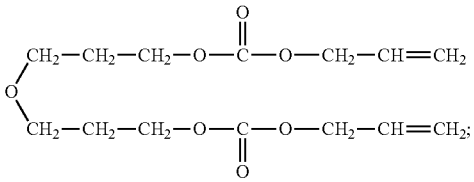

and mixtures thereof, or a styrene derivative liquid selected from the group consisting of:

Formula (B)

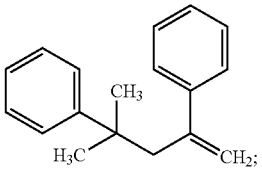

Formula (A)

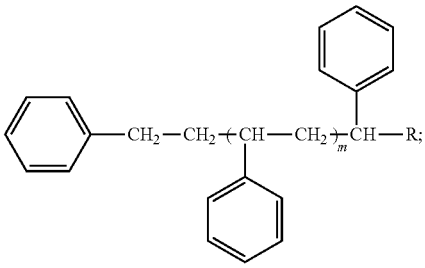

and mixtures thereof, wherein R is selected from the group consisting of H, $CH_3$, $CH_2CH_3$, and $CH{=}CH_2$, and m is between 0 and 3, or a fluoroketone liquid selected from the group consisting of:

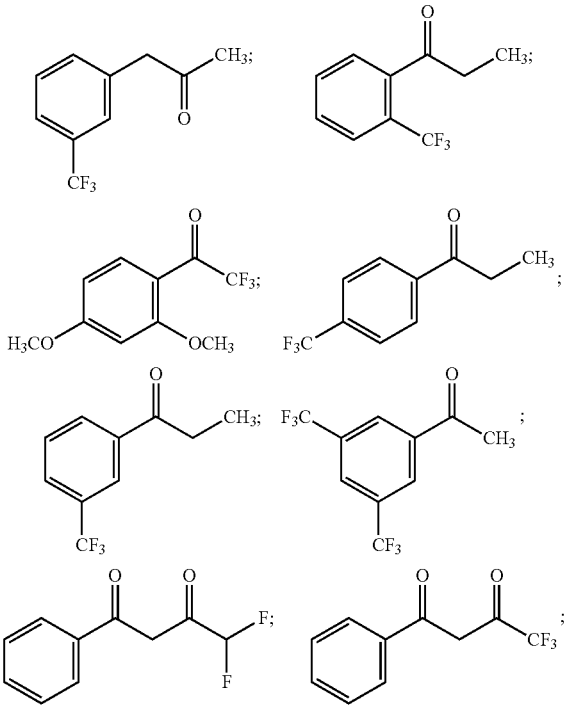

and mixtures thereof.

25. The flexible imaging member of claim 21, wherein the adhesion promoter in the plasticized anti-curl back coating layer is selected from the group consisting of: a linear saturated polymer of four diacids and ethylene glycol having a general molecular structure of:

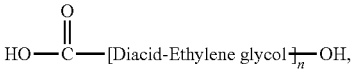

having a weight average molecular weight (Mw) of about 70,000 and a 1:1 mole ratio of diacid to ethylene glycol, further wherein the diacids are terephthalic acid, isophthalic acid, adipic acid, and azelaic acid in a mole ratio of 4:4:1:1; a linear saturated polymer of four diacids and ethylene glycol having a general molecular structure of:

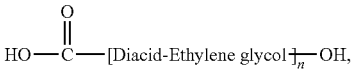

having a weight average molecular weight (Mw) of about 50,000 and a 1:1 mole ratio of diacid to ethylene glycol, further wherein the diacids are terephthalic acid and isophthalic acid in a mole ratio of 3:2; a linear saturated polymer of four diacids and ethylene glycol having a general molecular structure of:

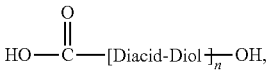

having a weight average molecular weight (Mw) of about 45,000 and a 1:1 mole ratio of diacid to diol, further wherein the diacids are terephthalic acid and isophthalic acid in a mole ratio of 1.2:1and the two diols are ethylene glycol and 2,2-dimethyl propane diol in a mole ratio of 1.33:1; and mixtures thereof.

26. The flexible imaging member of claim 21, wherein the inorganic particles or inorganic particle dispersion is present in an amount of from about 5 to about 10 weight percent based on the total weight of the plasticized anti-curl back coating layer.

27. The flexible imaging member of claim 21, wherein the inorganic particles selected for plasticized anti-curl back coating layer dispersion are selected from the group consisting of metal oxides, non-metal oxides, and mixtures thereof.

28. The flexible imaging member of claim 21, wherein the organic particles selected for plasticized anti-curl back coating layer dispersion are selected from the group consisting of polyterafluoroethylene, waxy polyethylene having a molecular formula $CH_3(CH_2)_mCH_3$, wherein m is between about 5 and about 15, a petrac oleamide having a molecular formula $CH_3(CH_2)_7CH{=}CH(CH_2)_7C{=}OCNH_2$, and a petrac erucamide having a molecular formula $CH_3(CH_2)_7CH{=}CH(CH_2)_{11}C{=}OCNH_2$.

29. The flexible imaging member of claim 21, wherein the plasticized charge transport layer has a Young's Modulus in the range of from about $2.5\times10^5$ psi ($1.7\times10^4$ Kg/cm$^2$) to about $4.5\times10^5$ psi ($3.5\times10^4$ Kg/cm$^2$) and a thermal contraction coefficient of between about $5\times10^{-5}$/° C. and about $12\times10^{-5}$ /° C., and the plasticized anti-curl back coating layer has a Young's Modulus in the range of from about $2.5\times10^5$ psi ($1.7\times10^4$ Kg/cm$^2$) to about $4.5\times10^5$ psi ($3.5\times10^4$ Kg/cm$^2$) and a thermal contraction coefficient of between about $5\times10^{-5}$/° C. and about $12\times10^{-5}$ /° C.

30. The flexible imaging member of claim 21, wherein the plasticized charge transport layer further comprises 8 weight percent diethyl phthalate plasticizer and a 1:1 weight ratio of bisphenol A polycarbonate to a charge transport compound of N,N'-diphenyl-N,N'-bis(3-methylphenyl)-1,1'-biphenyl-4,4'-diamine, has a glass transition temperature $Tg_{CTL}$ of 58° C. and is 29 micrometers in thickness.

31. The flexible imaging member of claim 30, wherein the plasticized ACBC further comprises 81 weight percent A-B diblock copolymer, 7 weight percent adhesion promoter, 5 weight percent PTFE dispersion, and 12 weight percent diethyl phthalate plasticizer and has a glass transition temperture Tg of 143° C. and is 17 micrometers in thickness.

* * * * *